US010135195B1

(12) United States Patent
Chen

(10) Patent No.: US 10,135,195 B1
(45) Date of Patent: Nov. 20, 2018

(54) RJ-45 PLUG FOR HIGH FREQUENCY APPLICATIONS

(71) Applicant: Surtec Industries, Inc, Keelung (TW)

(72) Inventor: Chou-Hsin Chen, Keelung (TW)

(73) Assignee: Surtec Industries, Inc., Keelung (TW)

( * ) Notice: Subject to any disclaimer, the term of this patent is extended or adjusted under 35 U.S.C. 154(b) by 0 days.

(21) Appl. No.: 15/810,538

(22) Filed: Nov. 13, 2017

(51) Int. Cl.

| | |
|---|---|
| ***H01R 12/00*** | (2006.01) |
| ***H01R 13/6466*** | (2011.01) |
| ***H01R 13/6469*** | (2011.01) |
| *H01R 12/58* | (2011.01) |
| *H01R 105/00* | (2006.01) |
| *H01R 24/28* | (2011.01) |

(52) U.S. Cl.
CPC ..... *H01R 13/6466* (2013.01); *H01R 13/6469* (2013.01); *H01R 12/585* (2013.01); *H01R 24/28* (2013.01); *H01R 2105/00* (2013.01); *H01R 2201/04* (2013.01)

(58) Field of Classification Search
CPC ..... H01R 13/6466; H01R 13/6469; H01R 24/28; H01R 2201/04; H01R 12/585
See application file for complete search history.

(56) References Cited

U.S. PATENT DOCUMENTS

2012/0227389 A1* 9/2012 Hinderks ..... F01B 1/10 60/317
2016/0101278 A1* 4/2016 Norris ..... A61M 1/166 604/29
2017/0165751 A1* 6/2017 Buller ..... B29C 64/35
2017/0296178 A1* 10/2017 Miller ..... A61B 17/0686

* cited by examiner

*Primary Examiner* — Jean F Duverne
(74) *Attorney, Agent, or Firm* — McGlew and Tuttle, P.C.

(57) ABSTRACT

A communications plug, for high frequency applications, includes a housing, a plurality of contact conductor blades and insulation displacement contacts. A printed circuit board has a plurality of transmission paths connecting corresponding blades and insulation displacement contacts. The plug has a major coupling including coupling between the blades. The PCB further includes a compensation coupling arrangement that provides a smaller coupling as compared to the major coupling. The compensation coupling is no more than one half of the major coupling and has a different polarity from that of the major coupling. The compensation coupling is connected to a set of transmission paths at a location between the major coupling and the insulation displacement contacts.

10 Claims, 29 Drawing Sheets

RJ-45 PLUG FOR HIGH FREQUENCY APPLICATIONS

FIELD OF THE INVENTION

The present invention relates to electrical connectors and more particularly relates to an RJ-45 plug for high frequency applications.

BACKGROUND OF THE INVENTION

Electrical connector plugs such as RJ-45 plugs have been used for network applications. These plugs include conductors wherein pairs of conductors are provided for each transmission path. Plugs such as RJ-45 plugs have eight conductors or four pairs for four different transmission lines. These may include a central pair and the split pair. With standard RJ-45 plugs, there exists huge capacitive coupling between the central pair blades and the split pair blades as well as the corresponding twisted-pair leads.

For high speed or high frequency applications capacitive coupling can harm the performance of the plug-jack pair. Capacitive coupling or capacitive reactance is a component of the impedance (Z) of the plug where Z(impedance)=R (resistance)+jX(capacitive reactance+inductive reactance). Capacitive coupling harming the performance is especially due to the arrangement of transmission paths with a central pair of conductors surrounded by a so-called split pair of conductors, namely one conductor on one side of the central pair and another conductor on another side of the central pair being part of one transmission path. Coupling (capacitive reactance) is particularly problematic in the region of the central pair and the split pair at the plug contacts.

Due to the significant capacitive variation caused by the arrangement of regular twisted pairs of wires and adjacent blades, it is difficult to reach the high performance with a regular twisted pairs and blades arrangement. More and more high performance plugs are using a printed circuit board (PCB) to replace twisted pairs to make a connection with the blades. Such blades have mounting and electrical connection pins connecting each blade, with pin mounts, on the PCB which are then connected to individual wires of a cable. In this way, the uncertainty of blades and twisted pair leads are removed. The circuit boards can use additional coupling to increase coupling that occurs at the plug conductors. However, with high frequency applications, namely frequencies increased to 2 GHz, for example, the application of Category 8, the coupling between blades can be no longer treated like a lumped capacitor; rather, they will behave more like coupled transmission lines. That means the couplings are no longer linear regarding the frequency. But the standard (TIA-568-C.2-1) requires a linear behavior of the plug couplings. The problem becomes worse if there are any couplings in the PCB circuits are added on to the blades couplings.

SUMMARY OF THE INVENTION

It is an object of the invention to provide a RJ-45 plug for high frequency applications with better control of the linearity of the plug coupling (capacitive reactance) regarding the frequencies. It is an object of the invention to provide an RJ-45 plug for high frequency applications which addresses issues relating to the compensation of phase changes due to the transmission line effect of the plug blades. Particularly for higher frequency applications, such as frequencies increased to the 2 GHz region.

It is an object of the invention to provide an RJ-45 plug for high frequency applications which has better performance characteristics as compared to prior art plugs, particularly better performance at higher frequencies.

According to the invention a communications plug, for high frequency applications, comprises a housing, a plurality of contact conductor blades and insulation displacement contacts. A printed circuit board (PCB) has a plurality of transmission paths connecting corresponding blades and insulation displacement contacts. The plug includes a major coupling comprising at least the coupling between immediately adjacent contact conductor blades and corresponding connected circuit parts of the PCB. The PCB further comprise a compensation coupling arrangement that provides a smaller coupling as compared to the major coupling. The compensation coupling is no more than one half of the major coupling and has a different polarity from that of the major coupling. The compensation coupling is connected to a set of transmission paths at a location between the major coupling and the insulation displacement contacts.

A magnitude of the compensation coupling arrangement is advantageously less than 1/10th of a magnitude of the major coupling. The compensation coupling arrangement may advantageously be electrically connected to the contact conductor blade at a path distance from the contact conductor blades that is more than 5 mm.

The corresponding connected circuit parts of the PCB advantageously further comprises a coupling arrangement adjacent to the plurality of contact conductor blades. The coupling arrangement forms a portion of the major coupling. The Telecommunications Industry Association (TIA) standard requires a specific amount of coupling. The coupling arrangement is used to achieve this requirement, given the coupling at the conductor blades. However, in the alternative, the major coupling may be fully or essentially provided by the conductor blades, such as by providing large blades that satisfy the requirement of the TIA as to a specific amount of coupling.

The PCB may have a plurality of blade conductor contact regions connecting respective contact conductor blades to the respective transmission paths associated therewith. The contact conductor blades may comprise a central pair of conductor blades disposed adjacent to each other and in electrical contact with a central pair of blade conductor contact regions of the plurality of blade conductor contact regions. The contact conductor blades may further comprise a split pair of conductor blades, with each split pair of conductor blades disposed adjacent to a respective one of the central pair of conductor blades and in electrical contact with a split pair of blade conductor contact regions of the plurality of blade conductor contact regions. The coupling arrangement may comprise a first split pair to central pair coupling portion provided on the PCB and electrically connected to one of the central pair of blade conductor contact regions and electrically connected to the adjacent split pair of blade conductor contact regions providing a capacitive coupling therebetween. The coupling arrangement may further comprise a second split pair to central pair coupling portion provided on the PCB and electrically connected to another of the central pair of blade conductor contact regions and electrically connected to the adjacent split pair of blade conductor contact regions providing a capacitive coupling therebetween. The first split pair to central pair coupling portion is connected to said one of the central pair of blade conductor contact regions and the adjacent split pair of blade conductor contact regions spaced a distance D therefrom. The second split pair to central pair coupling portion is connected to said another of the central pair of blade conductor contact regions and the adjacent split pair of blade conductor contact regions spaced a distance D therefrom. The compensation coupling arrangement comprises a split pair to central pair compensation coupling portion electrically connected to one of the traces connected to one of the central pair of blade conductor contact regions and electrically connected to one of the traces connected to one of the adjacent split pair of blade conductor contact regions that is adjacent to said one of the traces connected to one of the central pair of blade conductor contact regions providing a capacitive coupling therebetween. The compensation coupling arrangement is spaced a distance d, along the associated trace from the compensation coupling arrangement to the conductor contact regions, wherein d>>D.

The blade conductor contact regions connect respective contact conductor blades to the respective transmission paths associated with the PCB. Each blade may have an advantageous shape including a plug contact length portion having a blade contact length for contact with contact conductors of a receiving jack and an extending portion extending at an angle relative to the plug contact length portion. The extending portion terminates at conductor contact portion that has a contact surface that electrically and physically contacts the respective blade conductor contact region.

The housing may comprise one or more housing parts supporting the plurality of contact conductor blades and supporting the PCB and clamping the contact conductor blades and the PCB to press, with a pressing force, each of the plurality of contact conductor blades into contact with the associated one of the conductor contact regions of the PCB to provide a solderless electrical and physical connection between each of the contact conductor blades and a corresponding one of the transmission path blade conductor contact regions.

In the alternative, the housing comprises one or more housing parts supporting the plurality of contact conductor blades and supporting the PCB with each of the contact conductor blades comprising a plug contact portion and a conductive post integral with the plug contact portion. In this case the conductor contact regions comprise plated though openings of the PCB that receive one of the conductive posts to provide electrical contact between each plug contact region and associated contact conductor blade. The conductive posts received in the plated though openings stake the respective contact conductor blade to the PCB.

The housing may comprise one or more housing parts supporting plurality of contact conductor blades and supporting the PCB.

By adding a small compensation coupling far enough away from the main coupling—such as wherein d>>D, the small compensation will reduce the coupling at low frequency, but have little effect on add on to that at high frequency. This improves the linearity of the coupling. In particular, at lower frequencies (for example under 250 MHz) the blades of a traditional plug can be treated as lumped capacitors. As such their effect (impedance effect Zc) in the circuit is proportional to the frequency $Zc=1/j\omega c$, when $\omega=2\pi F$. With high frequency application the lumped-capacitor treatment (assumption) is no longer applicable. The contact blades have to be treated as transmission lines, i.e. small capacitors separated in a small distances connected in series. Every small capacitor has its phase. This requires a phasor analysis. Considering only two small capacitors to explain the situation of the blades for high frequency, at 100 MHz, the small distance between two capacitors causes a small phase difference, say 0.5°, so a vector summation will be very close to simply adding the magnitude of these two vectors. However, at much higher frequencies, for example 2 GHz, the phase difference will increase to 20 times, say 10°. As such the vector summation must use vector summation and not simply the added magnitudes of these two vectors.

The invention solves this problem by add a small compensative capacitor (in opposite polarity) that is less than 1/10 in magnitude of the major coupling. The major coupling is also controlled based on this being the coupling of the coupling arrangement and the coupling between the contact conductor blades. The compensation coupling is provided by the small compensative capacitor provided at a distance more than 5 mm away from the blades. The small compensative capacitor can compensate the combination effect of the of the major coupling at low frequency (parallel), but has less effect at high frequency. Hence the difference of the combination of capacitor couplings between low frequency and high frequency can be reduced and will be more linearly proportional to the frequency.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
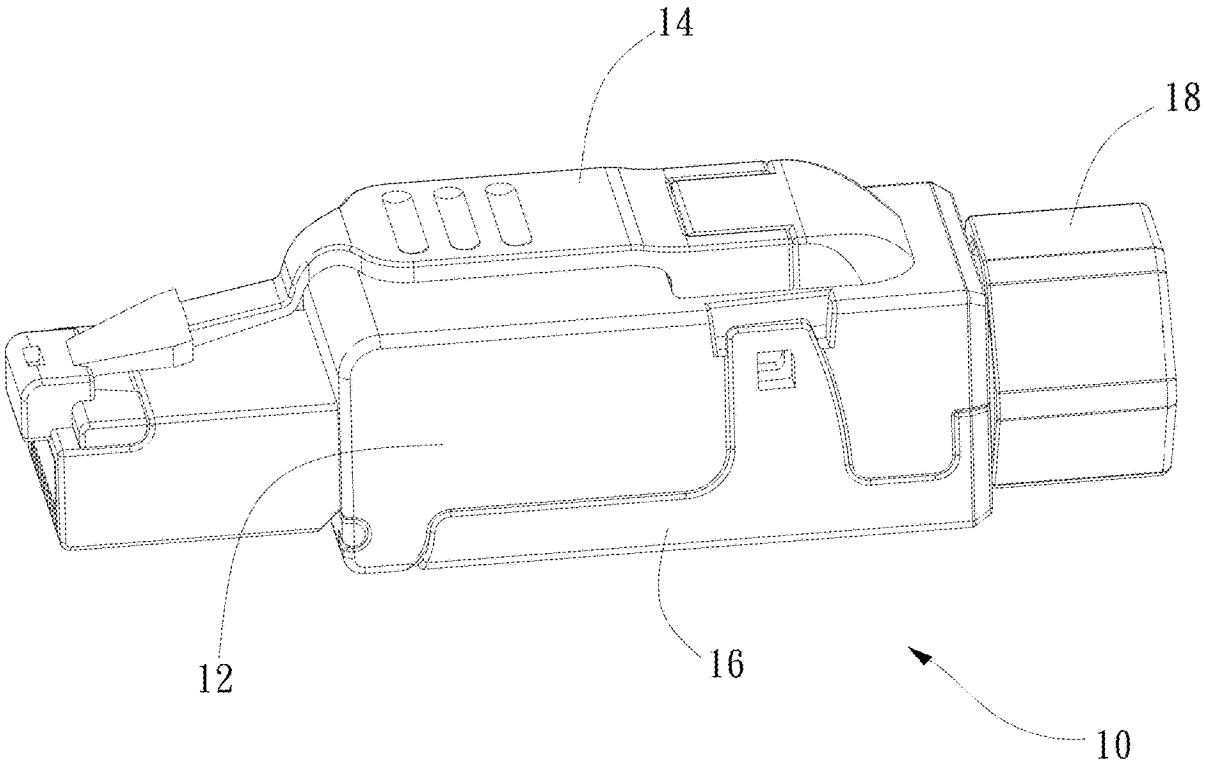
FIG. 1 is a perspective view of an RJ 45 plug according to the invention.

Referring to the drawings, FIG. 1 shows an RJ plug generally designated 10. The plug 10 comprises a main housing part 12 cooperating with a housing cover 16. A latch 14 is connected to an upper surface of the main housing part 12 and is used to latch the plug 10 in an electrical outlet (jack). A nut 18 provides an entry for wires of a cable (not shown) and provides a connection of the cable to the plug 10.

Figure 2:
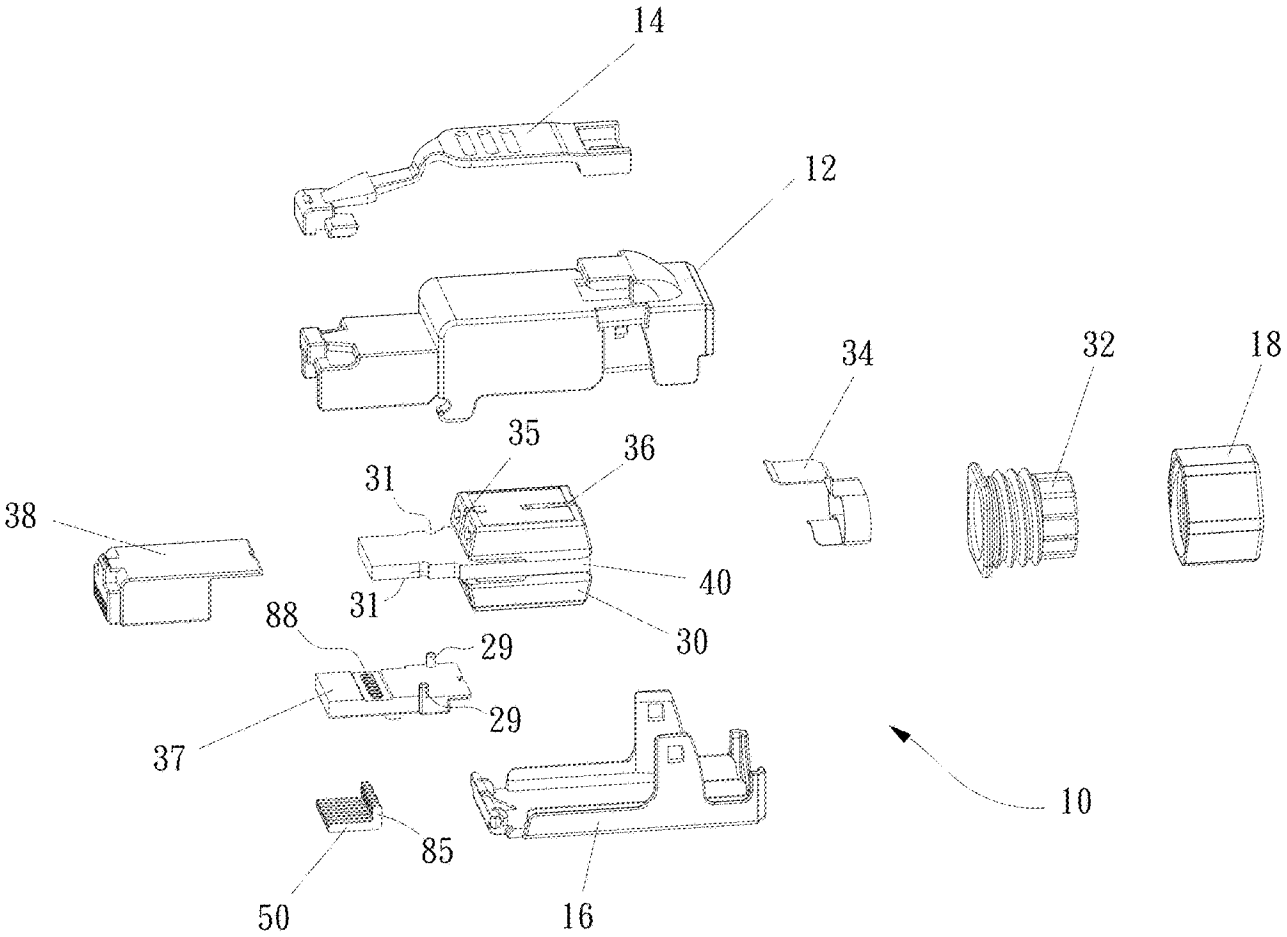
FIG. 2 is an exploded view of the plug according to FIG. 1.
Figure 3:
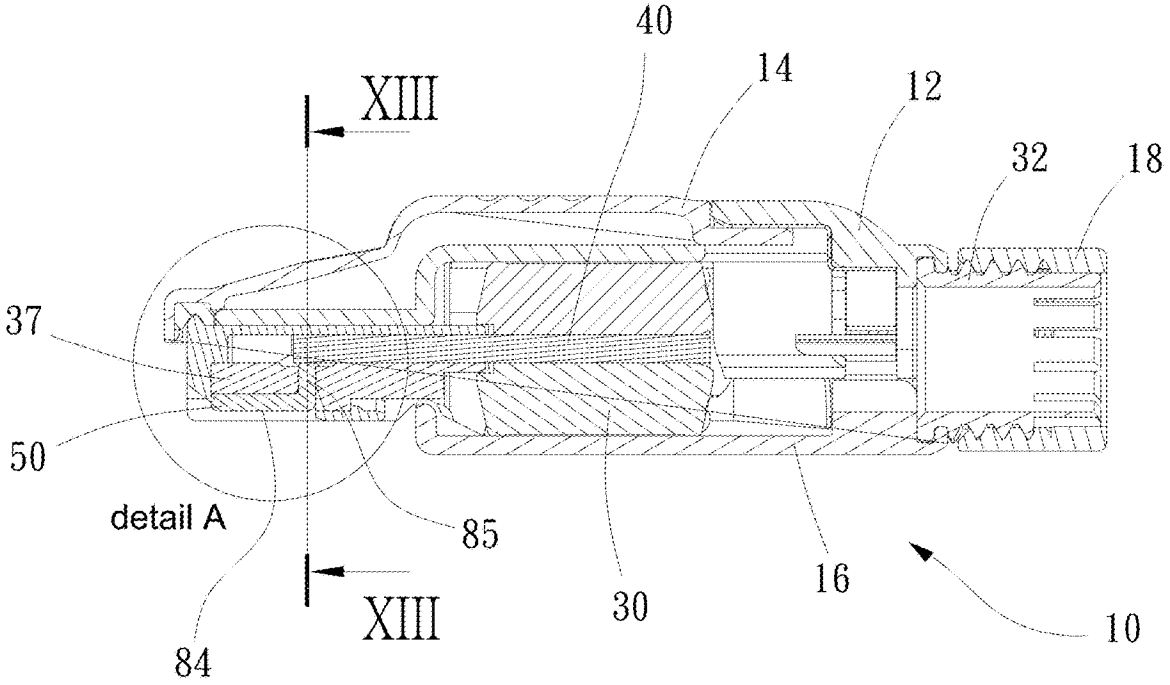
FIG. 3 is a sectional view taken along a longitudinal direction of the plug of FIG. 1.

FIG. 2 shows the plug 10 in an exploded view. The main housing part 12 cooperates with the cover 16 to provide an interior space to support a printed circuit board (PCB) 40 and a wire management assembly 30. The wire management assembly 30 supports and manages connections of the wires of the cable to wire terminals. The wire terminals are insulation displacement contacts (IDCs) that are inserted (staked) into the holes of the terminal contacts 72-78 of the PCB 40 and are fixed there with a solderless press connection. The conductive wires pass through the nut 18, pass through a set screw 32 and pass a grounding spring 34. The wires are put through the wire management assembly 30. The wire management assembly 30 is then pressed downwards to the PCB to make the connection of the wires of the cable with the IDCs.

As can be seen in FIG. 2, the wire management assembly 30 supports the PCB 40. The wire management assembly also supports a metal piece 36. The metal piece 36 is held in position relative to the PCB 40 and extends downwards from a metal piece grounding contact edge 35 and extends into a through gap 65 of the PCB 40, between portions of the PCB 40. The through gap 65 separates at least some of wire terminal contacts 71-78. The associated metal piece 36 separates at least some of the wire terminals that are connected to wire terminal contacts 71-78 of the PCB 40.

Blade conductors 50 are held in a conductor set base 37 in cooperation with conductor set cover 38. The conductor set base 37 holds and positions each of the blade conductors 50 in spaced apart relationship and in position within the housing 12.

Figure 4:
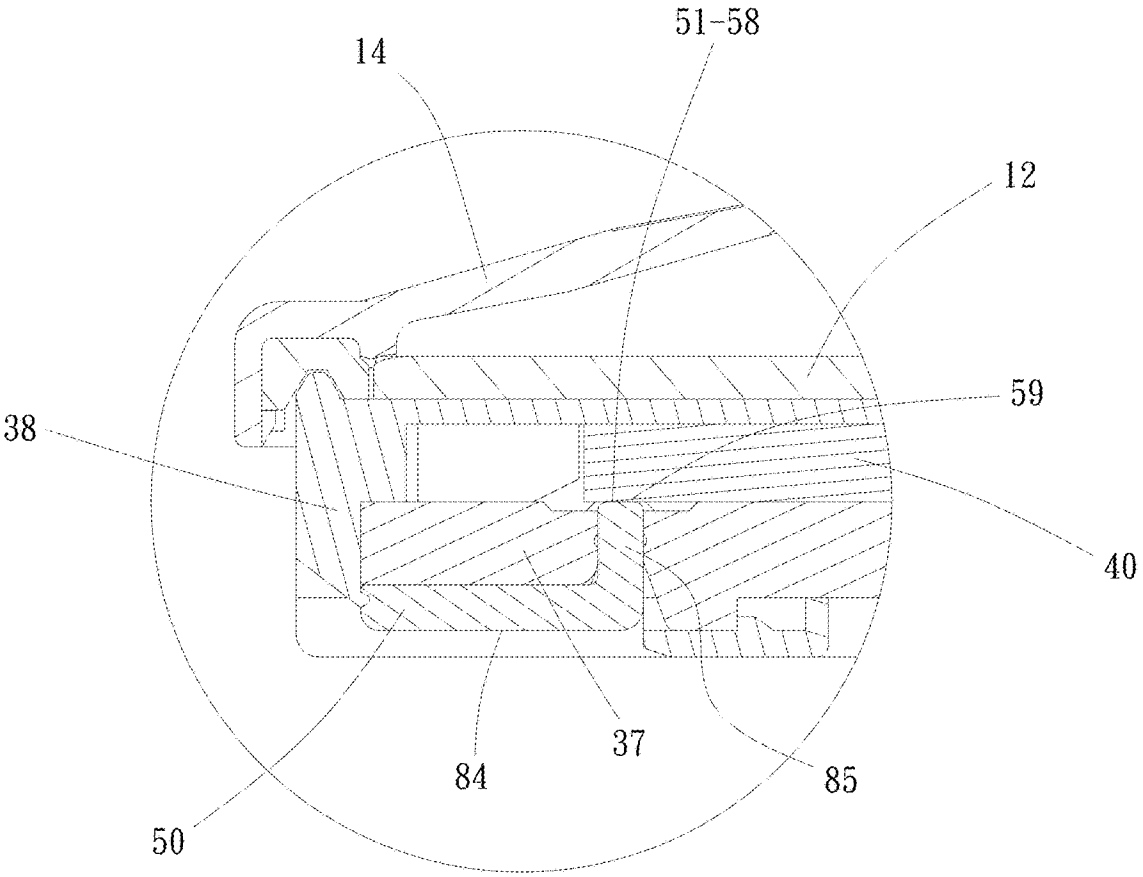
FIG. 4 is a detailed view of detail A of FIG. 3.
Figure 5:
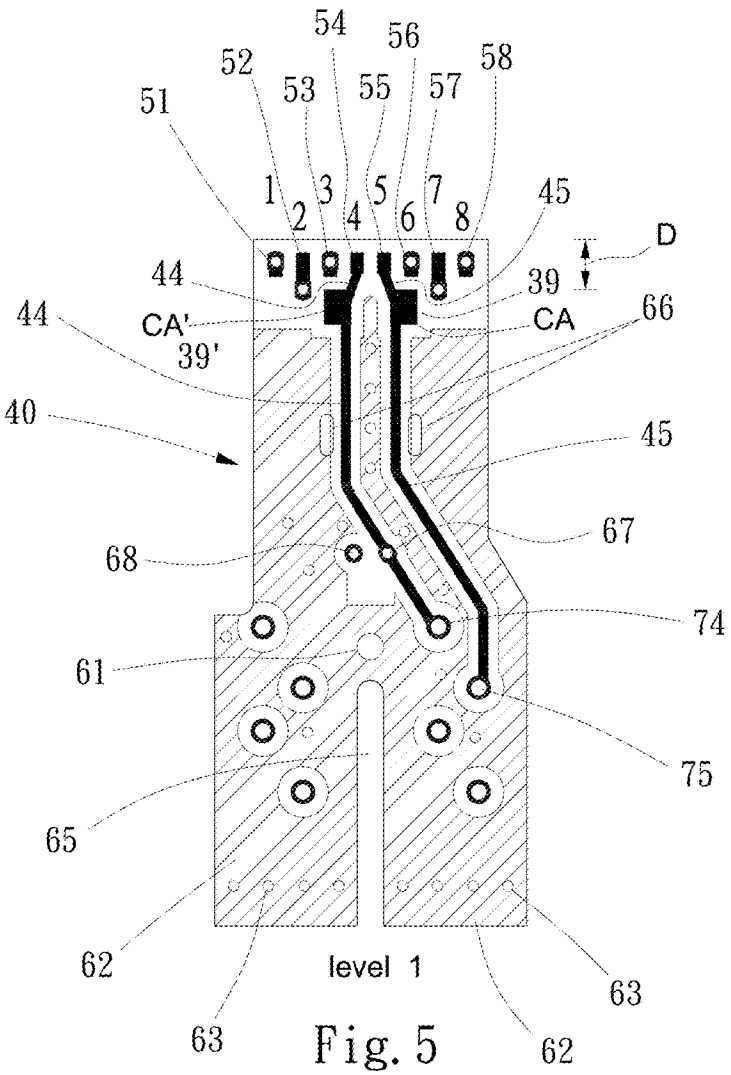
FIG. 5 is a bottom view showing a lower surface that is level 1 with a conductive layer area of the printed circuit board of the plug of FIG. 1.

The conductor set base 37 and conductor set cover 38 are connected together to position and hold the blade conductors 50 relative to the PCB 40. The PCB 40 has a lower surface (level 1) with a series of blade conductor contact regions 51-58 (FIG. 5). As can best be seen in FIG. 4, each of the blade conductors 50 has an upper surface defining a conductor contact portion 59. The assembly of the contacts with the conductor contact portion 59 of the blades 50 is such that the conductor contact portion 59 is pressed or forced toward the respective blade conductor contact region 51-58. The wire management assembly 30 holds and supports the PCB 40. The blades 50 each have the associated staked/pressed portion 85 pressed into or molded into passages 88 in conductor set base 37. The blades 50 are thereby each supported by conductor set base 37. The wire management assembly 30 is in supported contact, at upper and lower surfaces, with the housing parts 12, 16. The rigid housing part 12 bears on the upper surface of the wire management assembly 30, and on the upper surface of the conductor set cover member 38. The rigid housing part 16 bears on the lower surface of the wire management assembly 30, and bears on the lower surface of the conductor set base 37. The blade conductors 50 are pressed with the conductor set base 37 to provide a force biased contact (clamping contact) of each conductor contact portion 59 with the respective blade conductor contact region 51-58. The force biased contact or clamping contact (also known as a pre-load, pre-tension or pre-stress) is provided by the clamping action provided by the joining of conductor set base 37, holding the staked/pressed portion 85, with the conductor set cover member 38. The clamping action occurs with the PCB 40 and the blade conductors 50 being pressed together between housing parts 12, 16. This clamping, with the base 37, cover 38 and housing parts 12, 16, holds and supports the position of the blade conductors 50 with a pressing force applied between the individual conductor contact portion 59 of the blade conductors 50 and the respective blade conductor contact region 51-58. The conductor contact portion 59 of each of the blades 50 is non-elastically-deformable and pressed into physical and electrical contact, and particularly solderless electrical contact, with one of the blade conductor contact regions 51-58 of the PCB 40.

FIGS. 5-12 use the designations 1, 2, 3, 4, 5, 6, 7 and 8 to indicate transmission paths associated with transmission lines. Each transmission line is formed from a pair of transmission paths, that may be considered to be of different polarity. The transmission line pair 4, 5 is referred to as the central pair of a central transmission line 80 and the pair 3, 6 is referred to as the split pair of a split transmission line 90 (see FIG. 13). The peripheral pairs are pairs 1, 2 and 7, 8. Along the plug 10, the transmission paths are formed by the blade conductors 50, the conductor contact regions 51-58, the through contacts (via holes) 21, 22, 23, 26, 27 and 28 (for the pair 1, 2, for the split pair 3, 6 and for pair 7, 8), the traces 41-48, the wire terminal contacts 71-78 and the wire terminals and wires (not shown).

FIGS. 5-12 show, in sectional views of the PCB 40, the various layers with conductive material (shield material) 60, 62 and 64 forming a ground plane. The conductive material areas 60, 62 and 64 are made of conductive material connected together as discussed further below. FIGS. 5-12 show various levels (levels 1-8) of the PCB 40. The levels include conductive traces or other features such as coupling/compensation features and ground plane features described below. Level 1 is referenced as the lower surface or first side surface and level 8 is referenced as the upper surface or second side surface. Level 1 and level 8 may also be internal levels namely with the level essentially covered by FR4 or provided within outer layers of FR4 material. However, level 1 includes the conductor contact regions 51-58, which according to the embodiment of plug 10 of FIGS. 1-14 are positioned on an outer surface of the PCB 40, namely at the lower surface of the PCB 40. The conductor contact regions 51-58 are positioned relative to the blades 50 to provide the press contact as described above.

FIG. 5 shows plated through openings (via holes, through contacts) 21, 22, 23, 26, 27 and 28 are provided for connecting the blade conductor contact regions 51, 52, 53, 56 57 and 58 respectively to traces on one of the other levels of the PCB 40. The lower surface of the PCB 40 with the blade conductor contact regions 51-58 includes first split pair blade conductor contact region 53, first central pair blade conductor contact region 54, second central pair blade conductor contact region 55 and second split pair blade conductor contact region 56, that are of particular interest.

On the upper surface (first side) of the PCB 40 a first central pair trace 44 extends from the blade conductor contact region 54 to the wire terminal contact 74. The second central pair trace 45 extends from the blade conductor contact region 55 to the wire terminal contact 75. The first central pair trace 44 and the second central pair trace 45 are part of the central transmission line 80 (see FIG. 13). The traces 47 and 48 also extend on level 1 (the lower surface of the PCB 40) from the respective blade conductor contact region 57, 58 to the respective wire terminal contacts 77 and 78.

A coupling arrangement CA/CA' is provided very close to the respective blade conductor contact regions 53, 54, 55 and 56, spaced by a distance D and forms the major coupling M1 together with the coupling at the blade conductors 50. The coupling arrangement CA/CA' is used to achieve the TIA requirement for a defined coupling M1, given the coupling at the conductor blades. However, in the alternative, the major coupling M1 may be fully or essentially provided by the conductor blades 50, such as by providing large blades 50 that satisfy the requirement of the TIA as to a specific amount of coupling. The coupling arrangement CA/CA' includes a first split pair to central pair coupling CA formed by a coupling portion 39 connected by trace 45 to the blade conductor contact region 55 and a coupling portion 49 connected by a trace 79 and by through contact 26 to blade conductor contact region 56. This coupling between the transmission paths 5 (of the central pair) and 6 (of the split pair) is the same polarity of coupling as the polarity of the coupling that occurs between the adjacent blade conductors 50 of transmission paths 5 (of the central pair) and 6 (of the split pair). The coupling arrangement CA/CA' includes a second split pair to central pair coupling CA' formed by a coupling portion 39' connected by trace 44 to the blade conductor contact region 54 and a coupling portion 49' connected by a trace 79' and by through contact 23 blade conductor contact region 53. This coupling between the transmission path 4 (of the central pair) and transmission path 3 (of the split pair) is the same polarity of coupling as the polarity of the coupling that occurs between the adjacent blade conductors 50 of transmission paths 4 (of the central pair) and 3 (of the split pair). The coupling that occurs between the blades 50, particularly with central pair 4, 5 and split pair 3, 6 and the coupling provided by the coupling arrangement CA/CA' together provide the major coupling M1 of the plug 10. This major coupling occurs essentially fully in the region of the blades 50.

Figure 6:
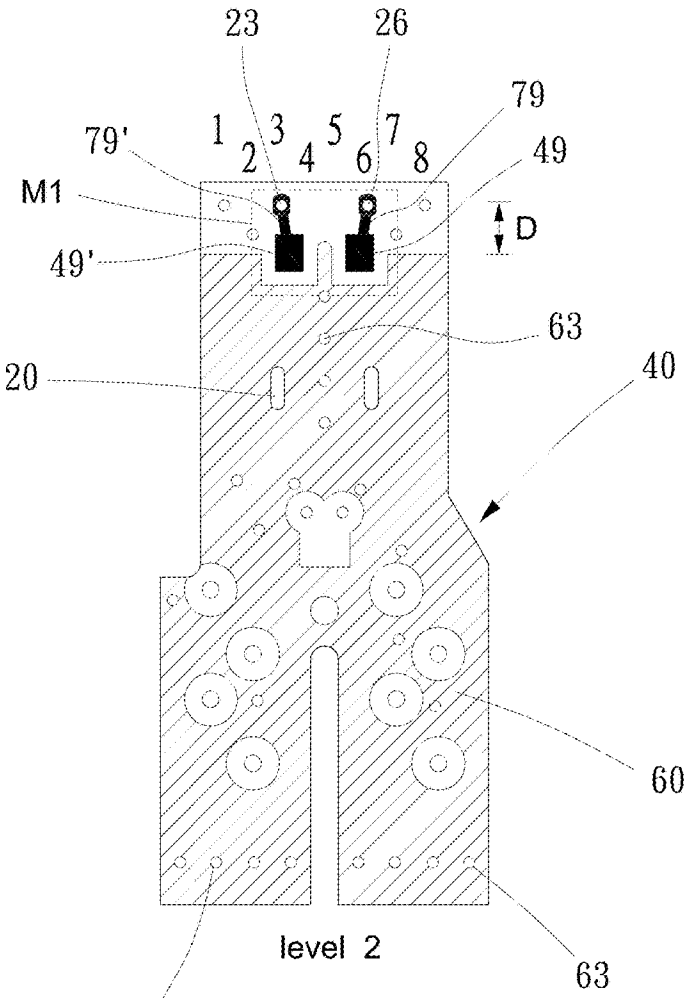
FIG. 6 is a sectional view taken through the PCB between the upper surface and the lower surface of the PCB, showing level 2 with a conductive layer area disposed between the upper surface and the lower surface of the PCB of the plug of FIG. 1.
Figure 7:
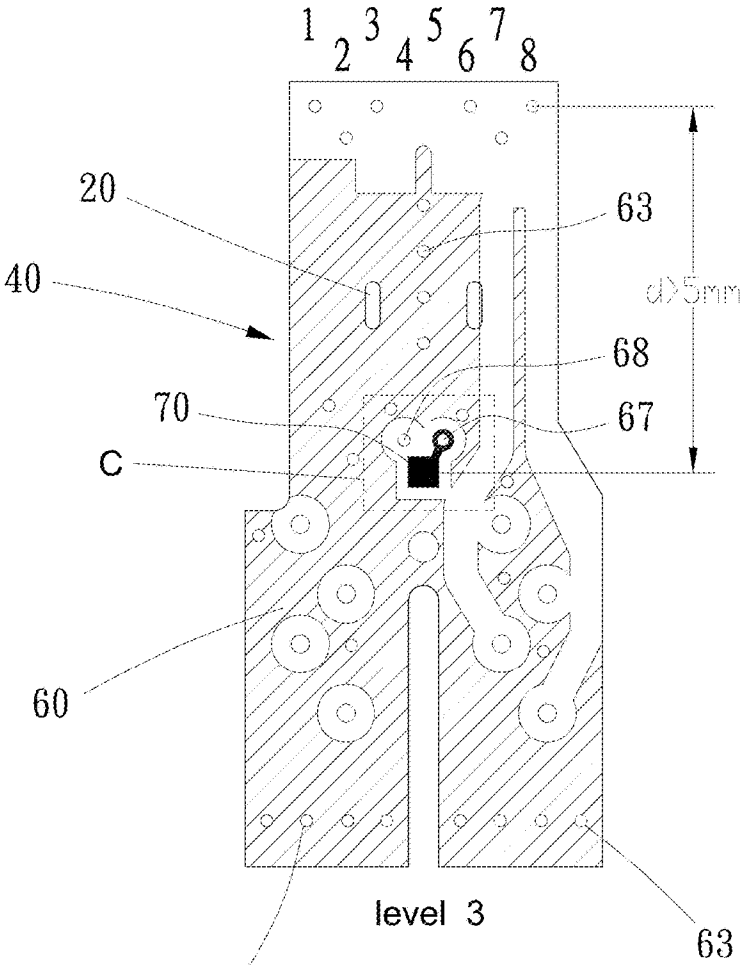
FIG. 7 is another sectional view taken through the PCB between the upper surface and the lower surface of the PCB, showing level 3 with a conductive layer area disposed between the upper surface and the lower surface of the PCB of the plug of FIG. 1.
Figure 8:
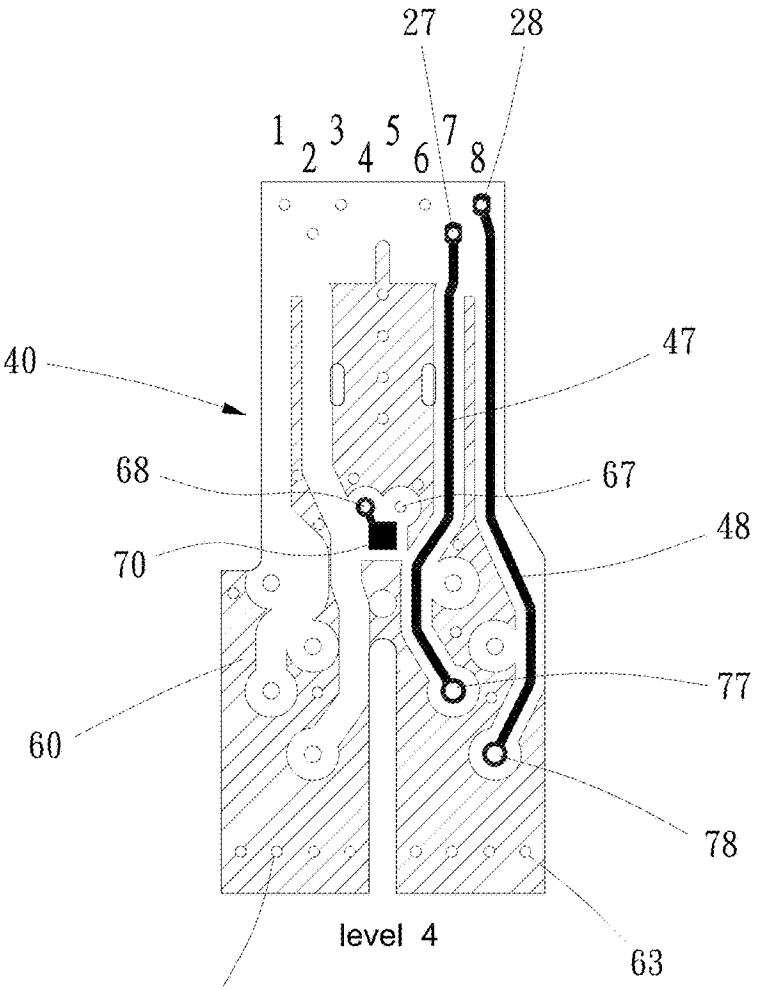
FIG. 8 is another sectional view taken through the PCB between the upper surface and the lower surface of the PCB, showing level 4 with a conductive layer area disposed between the upper surface and the lower surface of the PCB of the plug of FIG. 1.

Level 1 also includes a conductive layer 62. The conductive layer extends over most of level 1 except for nonconductive regions adjacent to the traces 44, 45, adjacent to the through holes 21, 22, 23, 26, 27 and 28 and the blade conductor contact regions 51, 52, 53, 56 57 and 58, adjacent to through holes 68 and 67 and adjacent to the wire terminal contacts 71-78. Terminal contacts 71-78 are plated through openings passing through each of the layers 1-4 holes. In FIGS. 6 and 7, the terminal contacts 71-78 (electrical contacts) are shown spaced from the conductive material areas 60. Between the large circle (interruption in the conductive material areas 60) and the small circle (terminal contacts 71-78) is non-electrical, avoiding the pins of the IDCs being shorted to ground. The conductive material areas 60 are in electrical connection with electrical through contacts 63. The electrical through contacts (via holes) 63 pass through the PCB 40 and electrically connect to intermediate conductive material areas 60 with conductive material areas 62 at the lower side of the PCB 40 (FIG. 5) and conductive material areas 64 at a upper side of PCB 40 (FIG. 8). The contact areas 62, 64 make electrical contacts with conductive material areas 60 at levels 2, 3, 4, 5, 6 and 7 and also make electrical contact with the grounding spring 34 to set the PCB 40 and grounding spring 34 as a complete ground (ground plane). Conductive material area 66 may also be applied to the inner facet of the openings 20 and also the inner facet of the gap 65.

Level 2 (FIG. 6) also includes an intermediate conductive material area 60. The PCB 40 may include many such intermediate conductive material areas 60. In the embodiment shown, six intermediate/internal layers of conductive material 60 are provided intermediate the lower conductive material area 62 in upper conductive material area 62. At level 2, there also nonconductive regions such as adjacent to the through holes 21, 22, 23, 26, 27 and 28 and adjacent to the trace and counter coupling portions 49. Nonconductive regions are also provided adjacent to through contacts 68 and 67 and adjacent to the wire terminal contacts 71-78. The conductive electrical through contacts 63 may be selectively positioned as described below to electrically connect each of the intermediate conductive layer material areas 60 to the other intermediate conductive layer material areas 60 and to the upper and the lower conductive material areas 62 and 64.

Figure 12:
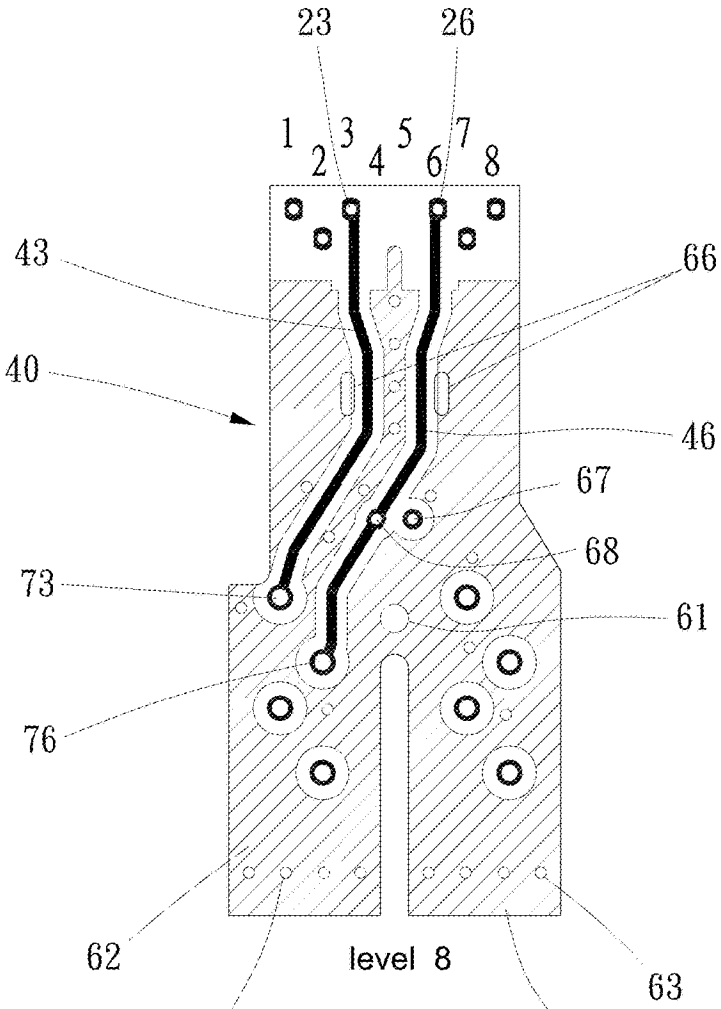
FIG. 12 is a top view showing the upper lower surface that is level 8 with a conductive layer area of the printed circuit board of the plug of FIG. 1.

Level 3 (FIG. 7) also includes an intermediate conductive layer material area 60 as well as nonconductive regions. A nonconductive region is particularly provided at conductive through holes 68 and 67. Conductive through hole 67 connects via a short trace to compensation coupling portion 69 of minor compensation coupling C. As can be seen in FIG. 8, level 4 also includes an intermediate conductive layer material area 60 with a nonconductive region at the conductor through holes 68 and 67. Conductive through hole 68 connects via a short trace to counter compensation coupling portion 70 at level 4. The coupling portion 68 and counter coupling portion 70 form a minor compensation coupling C, which provides minor coupling between line 4 of the central pair 4, 5 (FIG. 5) and line 6 of the split pair 3, 6 (FIG. 12). This coupling at minor compensation coupling C (between transmission paths 4 and 6) may be considered a different polarity (or opposite polarity) from that of the major coupling M1 (that is provided between transmission paths 5 and 6).

At level 4 (FIG. 8), traces 47 and 48 are connected to the through contacts 27 and 28 and extend to the wire terminal contacts 77 and 78 respectively. Level 5 (FIG. 9) also includes an intermediate conductive layer material area 60 with nonconductive regions including nonconductive regions with the traces 41, 42 corresponding to lines 1, 2, connected to the through contacts 21 and 22 and extending to the wire terminal contacts 71 and 72 respectively. Level 6 (FIG. 10) also includes an intermediate conductive layer material area 60 with nonconductive regions including nonconductive regions for the traces 41, 42. Level 7 (FIG. 11) includes an intermediate conductive layer material area 60 with nonconductive regions corresponding to the various conductive through holes.

FIG. 12 shows level 8 with a first split pair trace 43 extends from the through contact 23 to the wire terminal contact 73. The other, second, split pair trace 46 extends from the through contact 26 to the wire terminal contact 76. The split pair trace 46 is connected to the trough contact 68, to connect with the counter coupling portion 70 of the minor coupling C. As noted, the major coupling M1 includes the coupling provided by the coupling arrangement CA/CA' and the coupling provided by the blades 50 with all of the major coupling M1 being in the region of the blades 50. The minor compensation coupling C is small compared to the major coupling M1, particularly the minor compensation coupling C is no more than one half of the major coupling and more advantageously the compensation coupling arrangement C provides minor coupling magnitude that is less than 1/10th of a magnitude of the major coupling M1. The minor compensation coupling C is spaced away from the blades 50, in particular in the example is spaced away more than 5 mm from the blades 50 (see FIG. 7). In particular, the path length distance d to a midpoint of the compensation coupling C is greater than 5 mm and the path length D from the blade conductor contact regions 53 and 56 (as well as from the through contacts 23 and 26) to a midpoint coupling arrangement CA/CA' is much shorter than d (D<<d).

Figure 9:
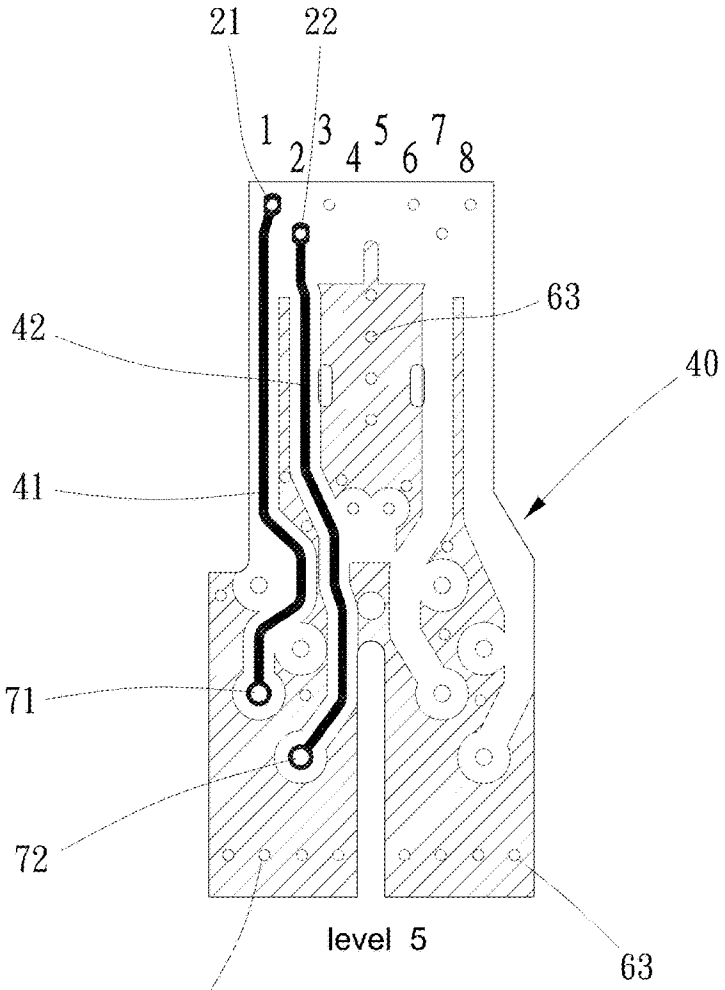
FIG. 9 is another sectional view taken through the PCB between the upper surface and the lower surface of the PCB, showing level 5 with a conductive layer area disposed between the upper surface and the lower surface of the PCB of the plug of FIG. 1.
Figure 10:
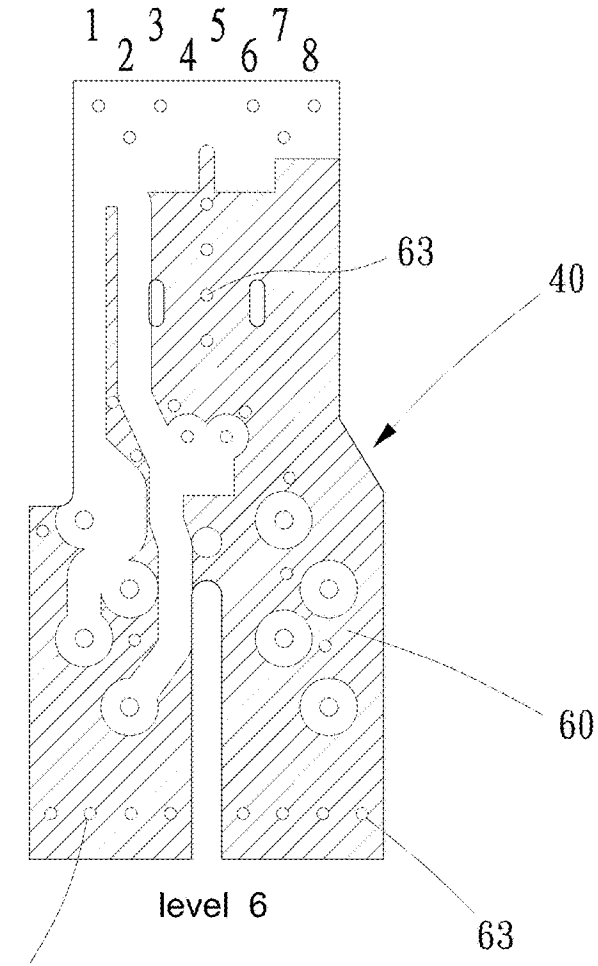
FIG. 10 is another sectional view taken through the PCB between the upper surface and the lower surface of the PCB, showing level 6 with a conductive layer area disposed between the upper surface and the lower surface of the PCB of the plug of FIG. 1.
Figure 11:
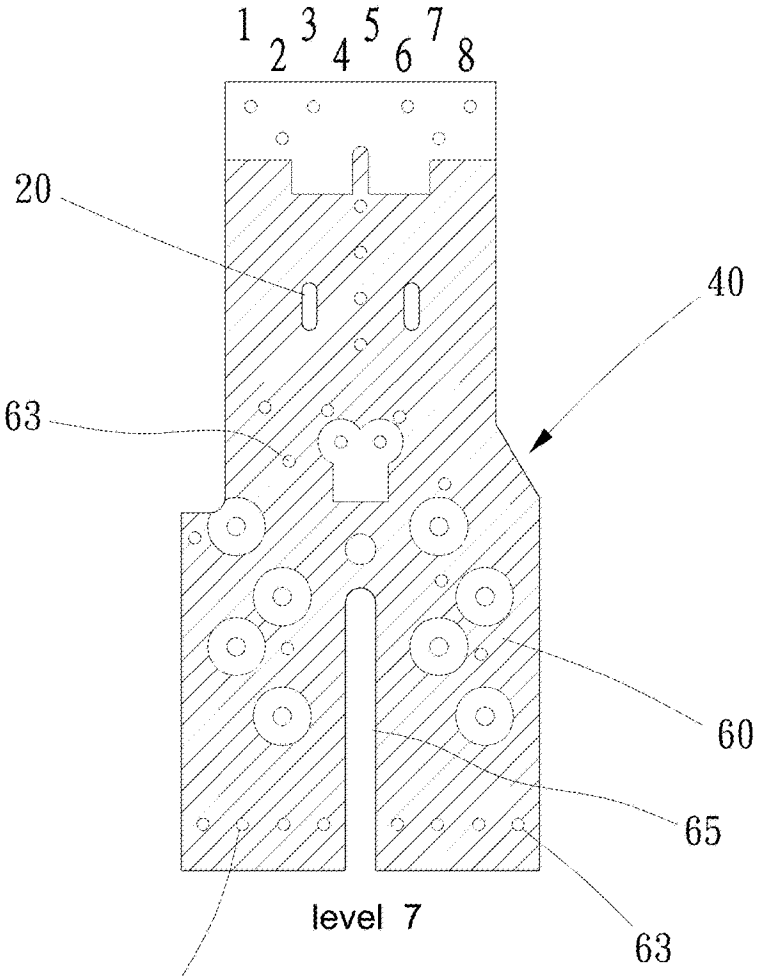
FIG. 11 is another sectional view taken through the PCB between the upper surface and the lower surface of the PCB, showing level 7 with a conductive layer area disposed between the upper surface and the lower surface of the PCB of the plug of FIG. 1.

The PCB 40 includes openings 20. One of the openings 20 provides separation between the central pair traces 44, 45 on the one hand and the traces 47 and 48 on the other hand. The other of the openings 20 provides separation between the split pair of traces 43, 46 on the one hand and the traces 41, 42 on the other hand. At a rear side of the PCB 40 (wire receiving side) the gap 65 provides separation between traces leading to terminal contacts 71, 72 on the one hand and terminal contacts 77 and 78 on the other hand. As noted, the metal piece 36 is held in the gap 65. The electrical through contacts 63 connect each of the various conductive layer material areas 60, 62 and 64. The through contacts 63 may be distributed in patterns to provide additional separation between the transmission lines and coupling of conductive areas 60, 62 and 64, and particularly conductive areas 60, 62 and 64, between particular traces. For example, the through contacts 63 connecting conductive areas 60, 62 and 64, follow the conductive material 62 between the paths of the traces 44 and 45 (FIG. 5). The through contacts 63 join the conductive material areas between traces 41 and 42 to the other layers (FIG. 9). The conductive area 62 between traces 43 and 46 is connected by numerous through contacts 63 to the various other layers 62, 60. Both the position of the through contacts 63 and the pattern of the conductive areas 60 or 62 are utilized to establish the ground plane and to avoid further coupling between lines.

Figure 13:
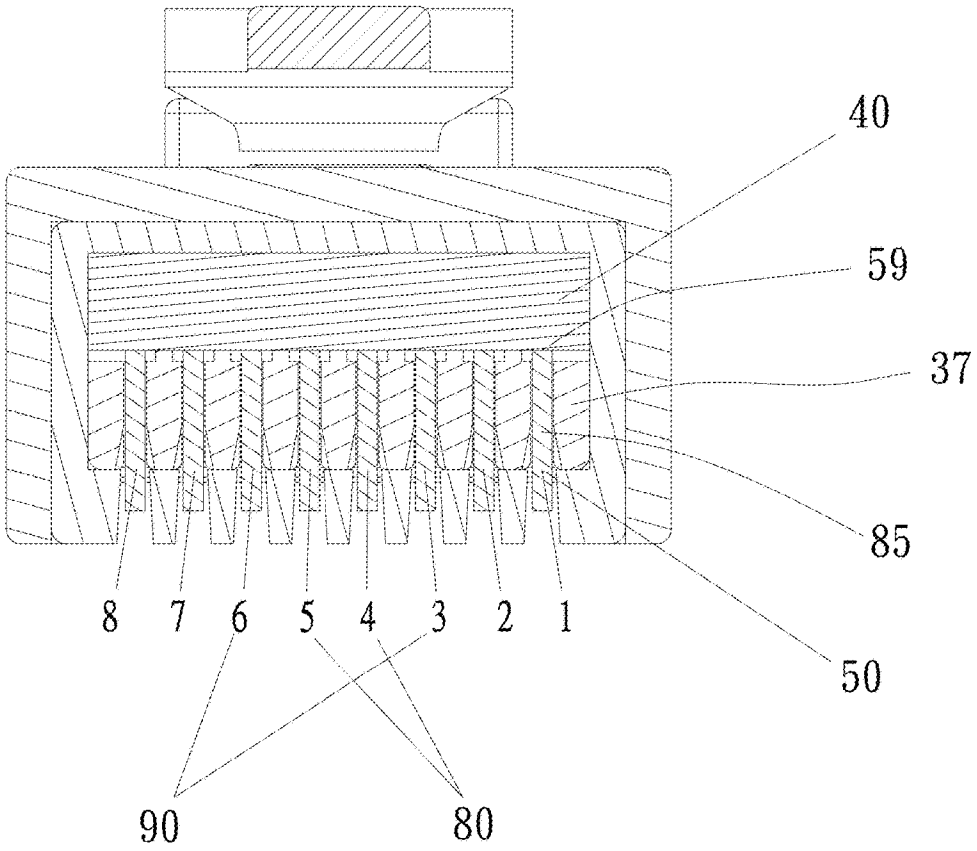
FIG. 13 is a sectional view taken along section line XIII-XIII of FIG. 3.

As can be seen in FIG. 13, the proximity of the conductors 50 of the central pair transmission line 80 and the split pair transmission line 90 contributed to the major coupling M1. Particularly with the one or more layers of conductive material areas 60, 62 and 64 and the central pair traces 44 and 45 being on one side (on the lower side—FIG. 5) of the PCB 40 and the split pair of traces 43 and 46 being on another level (on the upper side—FIG. 12) of the PCB 40, transmission signals on the central pair (4, 5) transmission line 80 are not coupled with transmission signals on the split pair transmission line 90, at least in the region of the PCB 40. The conductive material areas 60, 62 and 64 and 66 suppresses or removes significant variation of dielectric characteristics of the FR4 of the PCB 40 to control and reduce coupling effects. The conductive layer 66 is provided at the inner surface of the opening 20 and also at the gap 65.

The shape of the blades 50, with the conductor contact portion 59, is also particularly advantageous as to reducing coupling in the area of the blades 50. The blades each include a plug contact length portion (shown horizontally extending) 84 and an extending portion staked/pressed portion 85 (shown vertically extending) that terminates at conductor contact portion 59 that has a contact surface that electrically and physically contacts the respective blade conductor contact region 51, 52, 53, 56 57 or 58. The horizontally extending portion 84 is at an angle (a 90 degree angle) to the vertically extending plug contact length portion 85. The vertically extending portion 85 is advantageously much shorter than the horizontally extending portion 84. A length of the vertically extending portion 85 need only be long enough to pass through (and preferably be staked in) conductor set base 37 and to provide the contact at the contact portion 59. The horizontally extending plug contact portion 84 is sufficiently long to provide the plug contact surface of the respective blades 50, for contact with contact conductors of a receiving jack.

The plug 10 may have the housing parts 12, 16 made of metal. The conductor set cover 38, conductor set base 37 and the wire management assembly 30 are formed of a suitable plastic such as Polycarbonate (PC), Polyethylene (PE) or Liquid Crystal Polymer (LCP). The conductive layer material areas 60, 62, 64 and 66 are conductive metal layers, such as a copper foil or other conductive foil or conductive material layer.

As noted above, the PCB 40 may be formed with several layers. The layers of the PCB 40 at least include a layer forming the upper surface and lower surface. The PCB layers with the traces 41-48 may be FR4 substrate layers (glass-reinforced epoxy laminate sheet layers). One or more further FR4 or PC layers may be provided. More than one intermediate conductive layer area 60 may be provided, such as layers of conductive material 60 with intervening layers of FR4 or PC. There is at least one intermediate conductive layer area 60, a layer of conductive material, such as copper foil, provided between the layer with the upper conductive material area 64 and the lower conductive material area 62 of the PCB 40.

Figure 14:
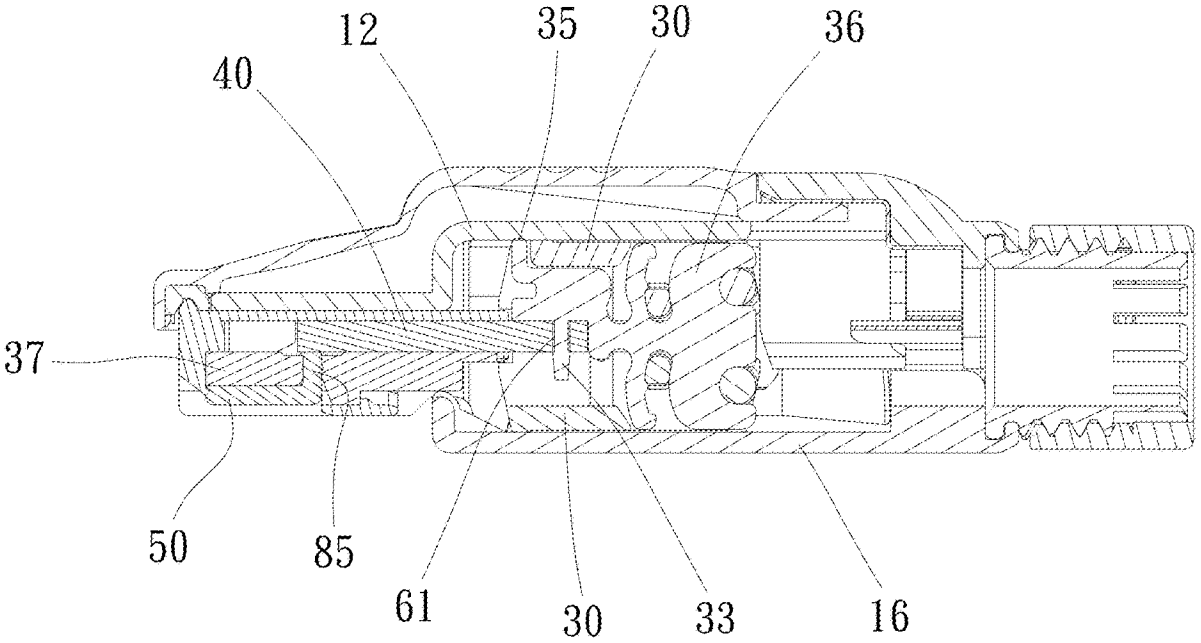
FIG. 14 is a sectional view taken in a plane passing through a conductive metal element and along a longitudinal direction of the plug of FIG. 1.
Figure 15:
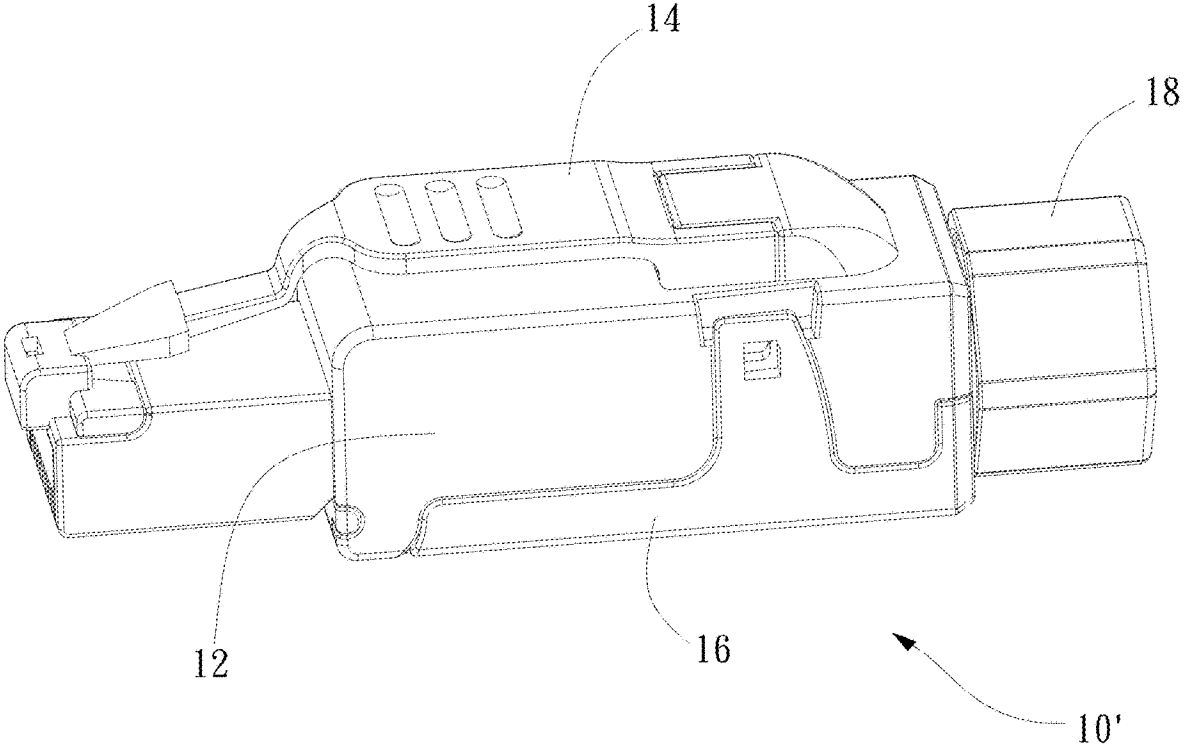
FIG. 15 is a perspective view of another RJ 45 plug according to the invention.
Figure 16:
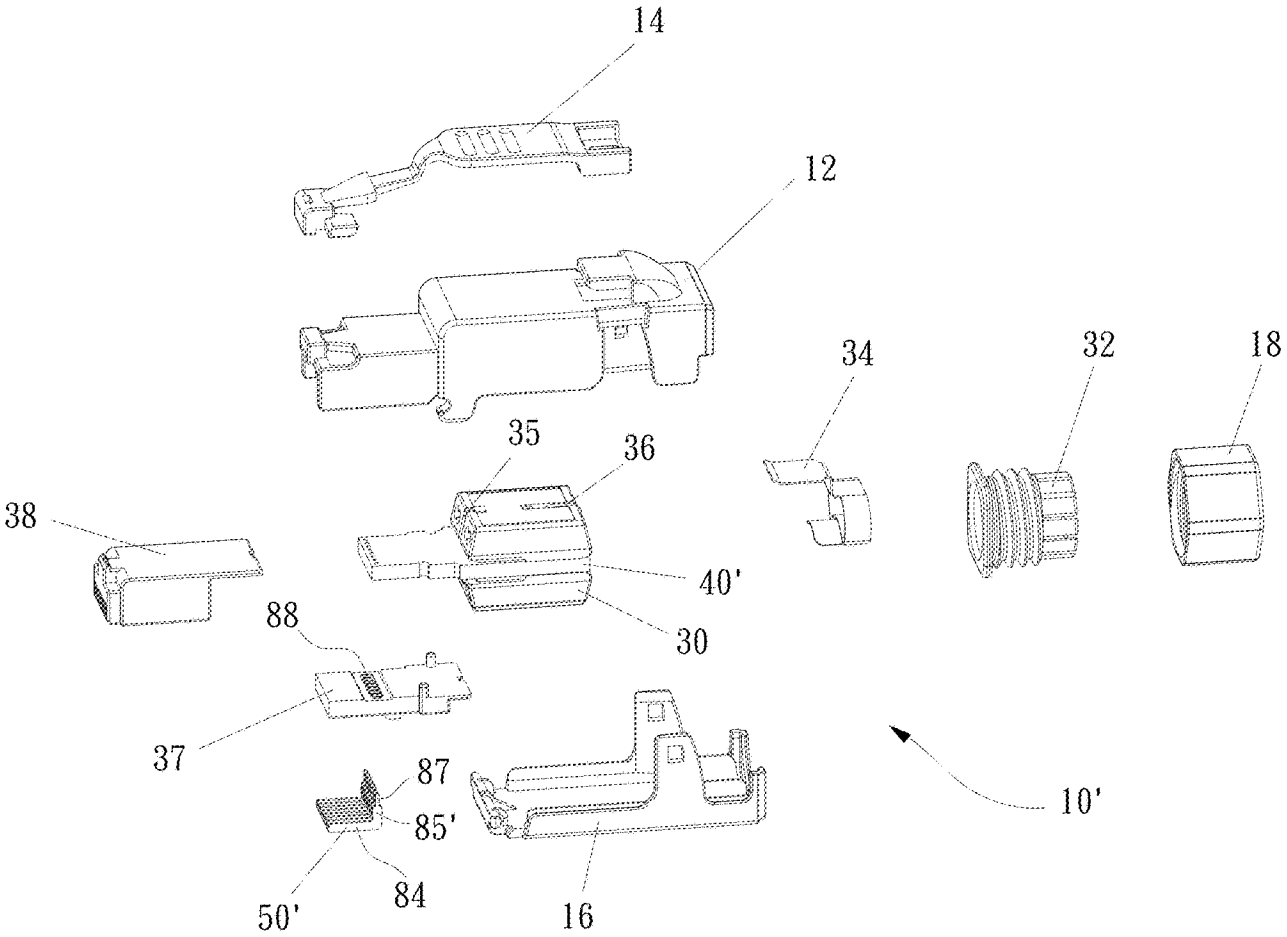
FIG. 16 is an exploded view of the plug according to FIG. 15.
Figure 17:
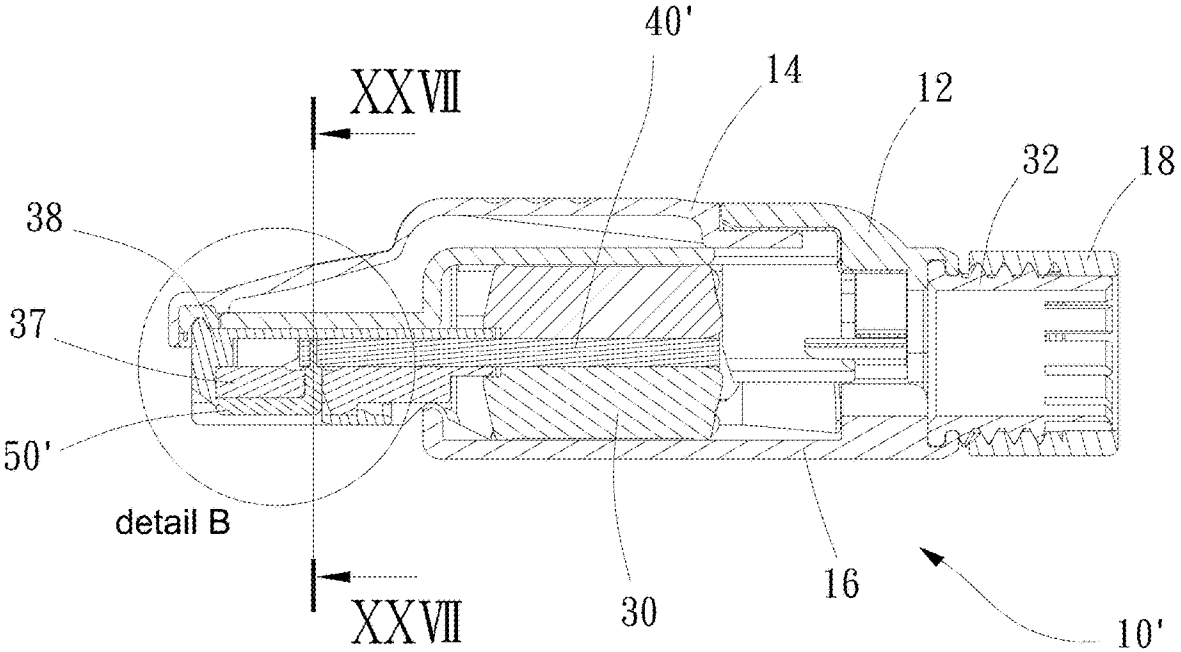
FIG. 17 is a sectional view taken along a longitudinal direction of the plug of FIG. 15.

The connection of the wire management assembly 30 to hold and support the PCB 40 supports the connection of the metal piece 36 with the PCB 40. The metal piece 36 has conductive pins 33 that pass through and make electrical and physical contact with conductive through openings 61 in the PCB 40 (FIG. 14). The conductive through openings 61 are in electrical contact with the conductive layer areas 60 and by vias (through contacts) 63 with conductive layer areas, 62, and 64. The conductive pins 33 provide a conductive connection of all of the conductive layer areas 60, the electrical through contacts 63, conductive layer areas 62, 64 and the opening inner facet conductive layer material 66 with the metal piece 36. The configuration forms a complete and connected ground plane. The metal piece 36 is elastically deformable and is in electrical contact at grounding contact edge 35 with the conductive metal housing part 12 (FIG. 14). The grounding spring 34 contacts the housing 12. The metal piece 36 contacts the conductive layer system of PCB by touching the conductive layered gap 65 and also based on the two pins 33 in the two electrically conductive through holes 61. This forms the complete connected ground plane. The complete ground plane is connected via the grounding spring 34 to a ground shield of the cable carrying the wires.

FIGS. 15-28 show another embodiment of a plug 10' according to the invention. Where the features are quite similar or essentially the same in each of the embodiments, the same reference numerals are used. However, plug 10' include several features which are different from the features described above with regard to plug 10. The different features essentially relate to the shape and contact aspects of blade conductors 50' and related minor differences at the blade conductor contact regions 51'-58' of the PCB 40'.

Plug 10' also has the major coupling M1 comprised of coupling arrangement CA/CA' plus the coupling that occurs at the blades 50'. The major coupling M1 is again physically very close to the blades 50'. In particular the electrical path distance D from the coupling portions (trace capacitor areas) 39/39' and 49/49' of the coupling arrangement CA/CA' to the blade conductor contact regions 53, 54, 55 and 56 is made to be very short and particularly much shorter than a transmission path length d of the compensation coupling portions 69, 70 of the compensation coupling C and associated traces from the blades 50'. In the example of plug 10', the path length distance d to a midpoint of the compensation coupling C is greater than 5 mm and the path length D from the blade conductor contact regions 53 and 56 (as well as from the through contacts 23 and 26) to a midpoint of the coupling arrangement CA/CA' is much shorter than d (D<<d). The compensation coupling C provides a smaller coupling as compared to the major coupling comprised of major coupling M1 plus the coupling that occurs at the blades 50'. In particular the compensation coupling C is no more than one half of the major coupling (comprised of major coupling M1 plus the coupling that occurs at the blades 50').

Figure 18:
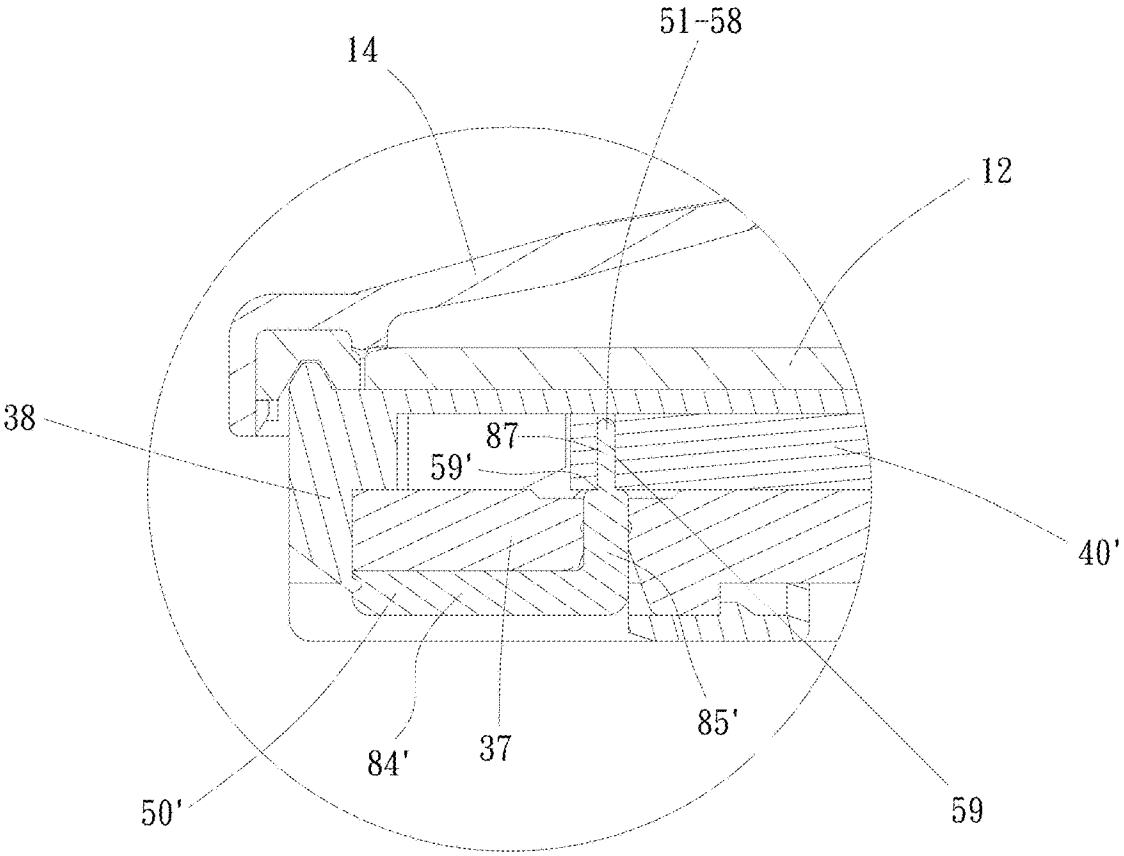
FIG. 18 is a detailed view of detail B of FIG. 17.
Figure 19:
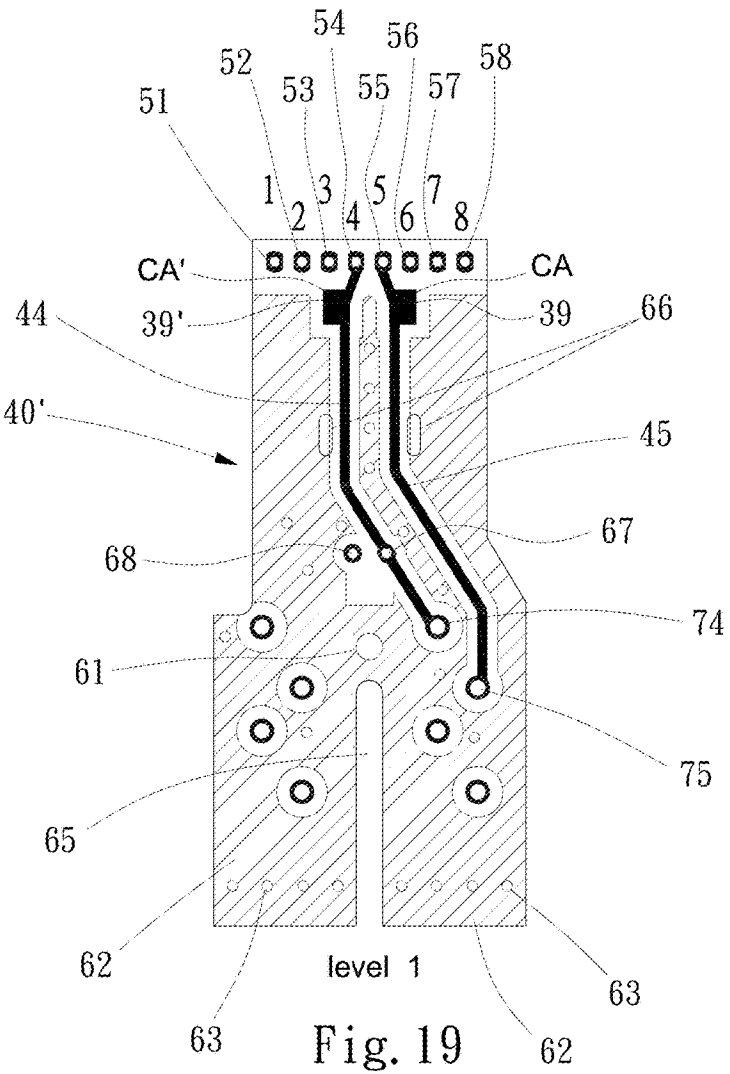
FIG. 19 is a bottom view showing a lower surface that is level 1 with a conductive layer area of the printed circuit board of the plug of FIG. 15.
Figure 20:
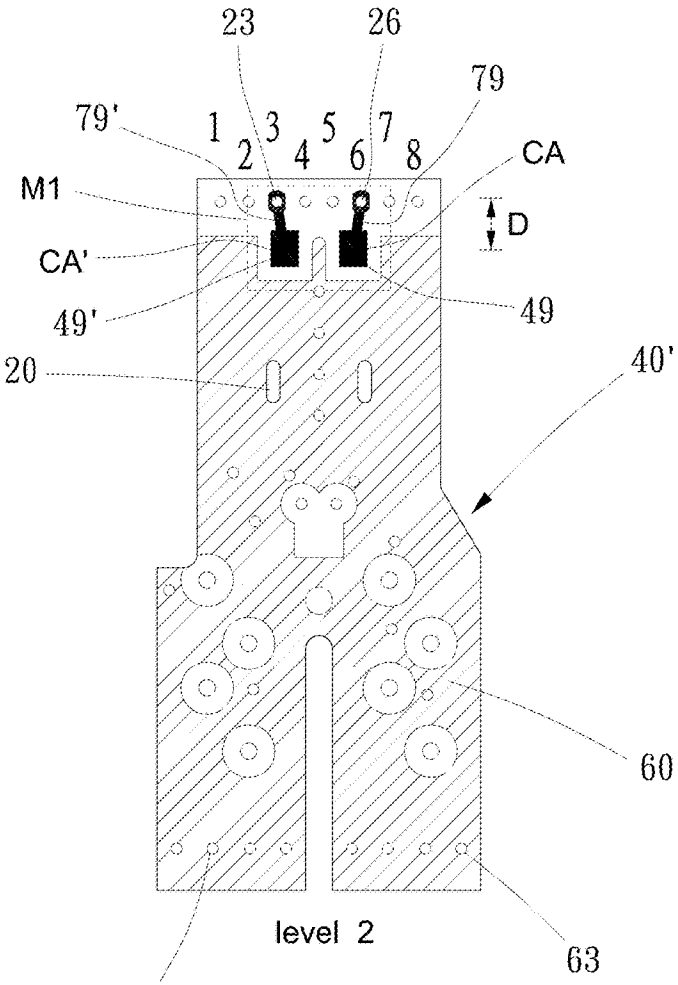
FIG. 20 is a sectional view taken through the PCB between the upper surface and the lower surface of the PCB, showing level 2 with a conductive layer area disposed between the upper surface and the lower surface of the PCB of the plug of FIG. 15.
Figure 21:
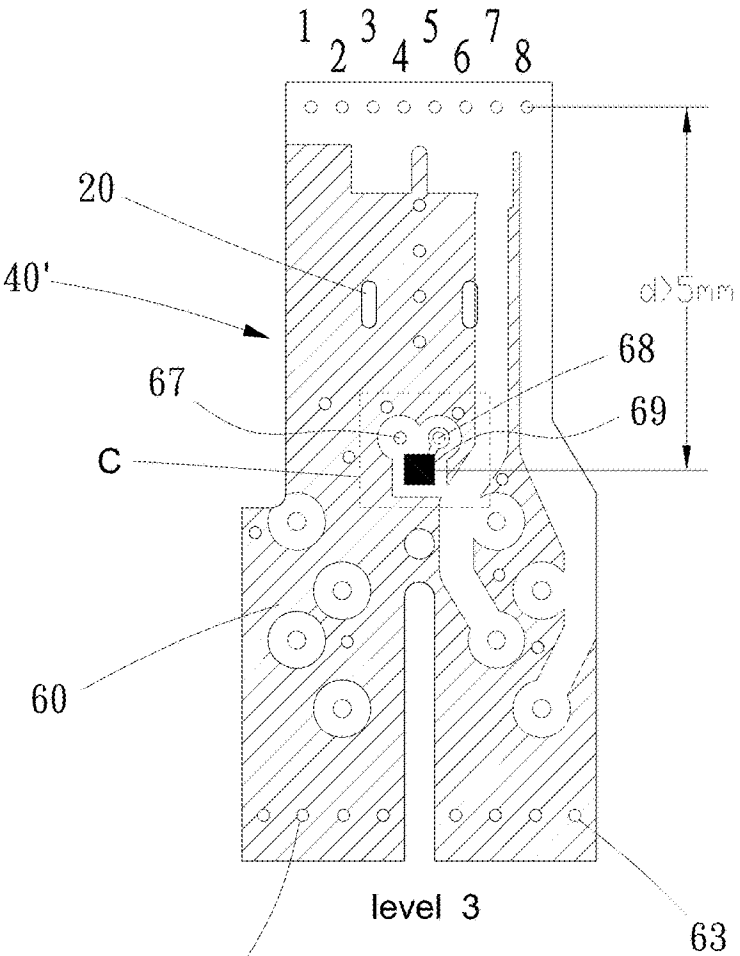
FIG. 21 is another sectional view taken through the PCB between the upper surface and the lower surface of the PCB, showing level 3 with a conductive layer area disposed between the upper surface and the lower surface of the PCB of the plug of FIG. 15.
Figure 22:
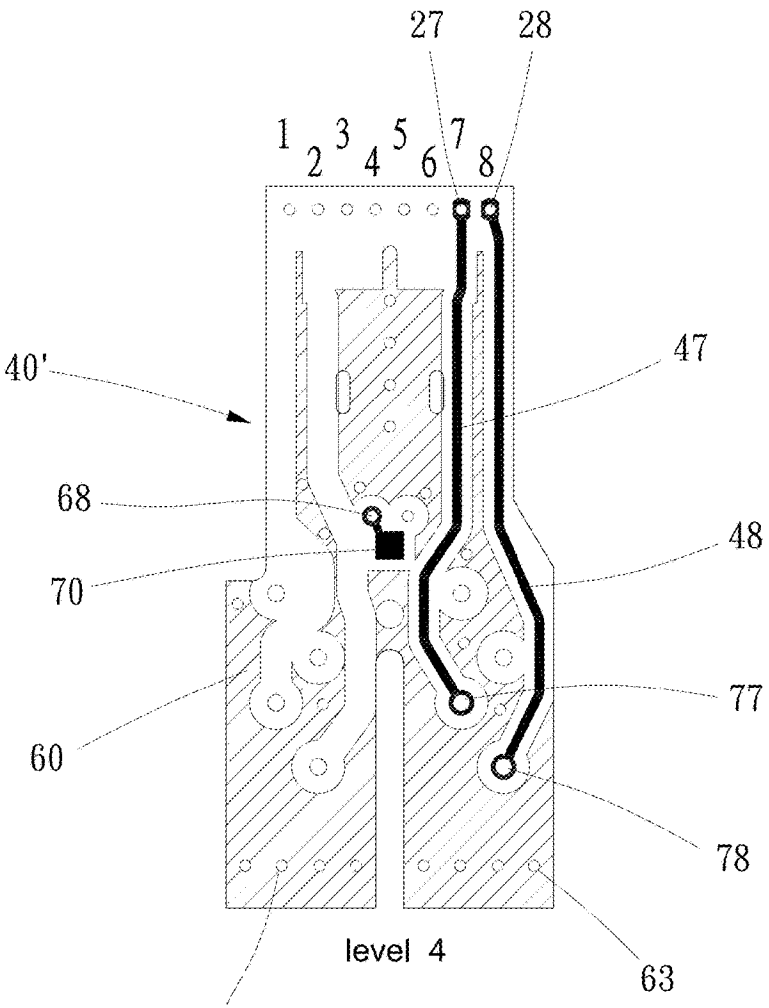
FIG. 22 is another sectional view taken through the PCB between the upper surface and the lower surface of the PCB, showing level 4 with a conductive layer area disposed between the upper surface and the lower surface of the PCB of the plug of FIG. 15.
Figure 23:
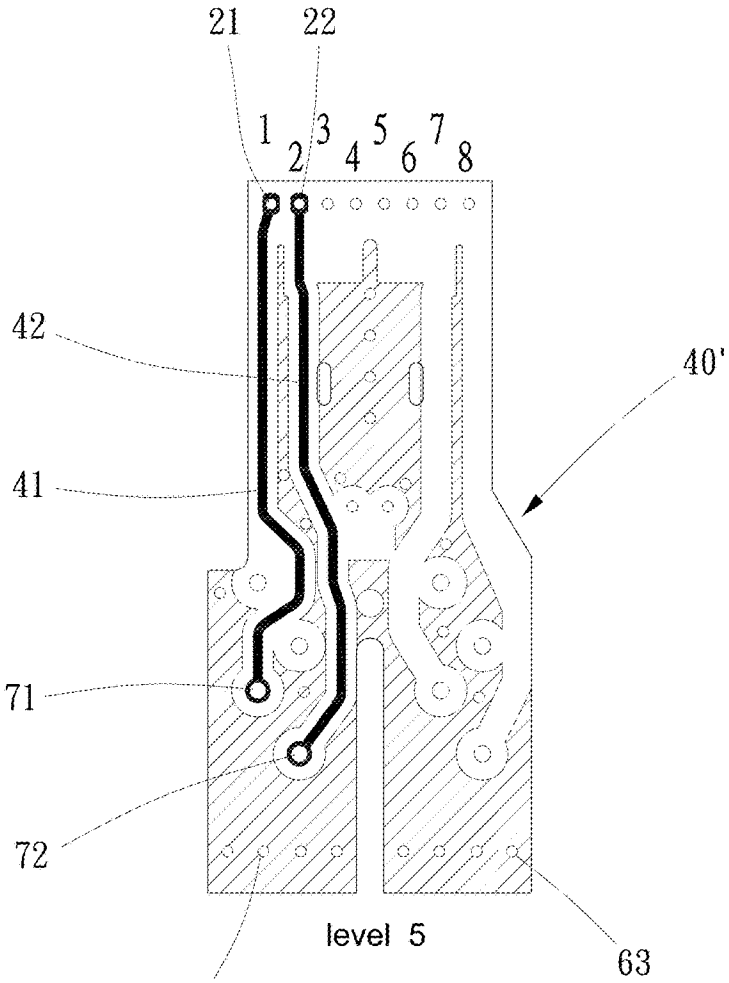
FIG. 23 is another sectional view taken through the PCB between the upper surface and the lower surface of the PCB, showing level 5 with a conductive layer area disposed between the upper surface and the lower surface of the PCB of the plug of FIG. 15.
Figure 24:
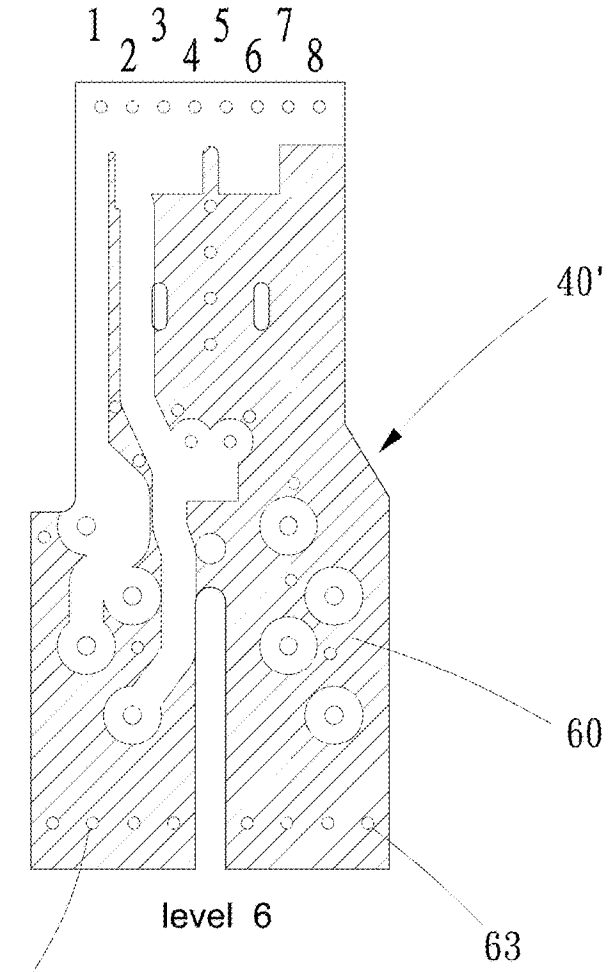
FIG. 24 is another sectional view taken through the PCB between the upper surface and the lower surface of the PCB, showing level 6 with a conductive layer area disposed between the upper surface and the lower surface of the PCB of the plug of FIG. 15.
Figure 25:
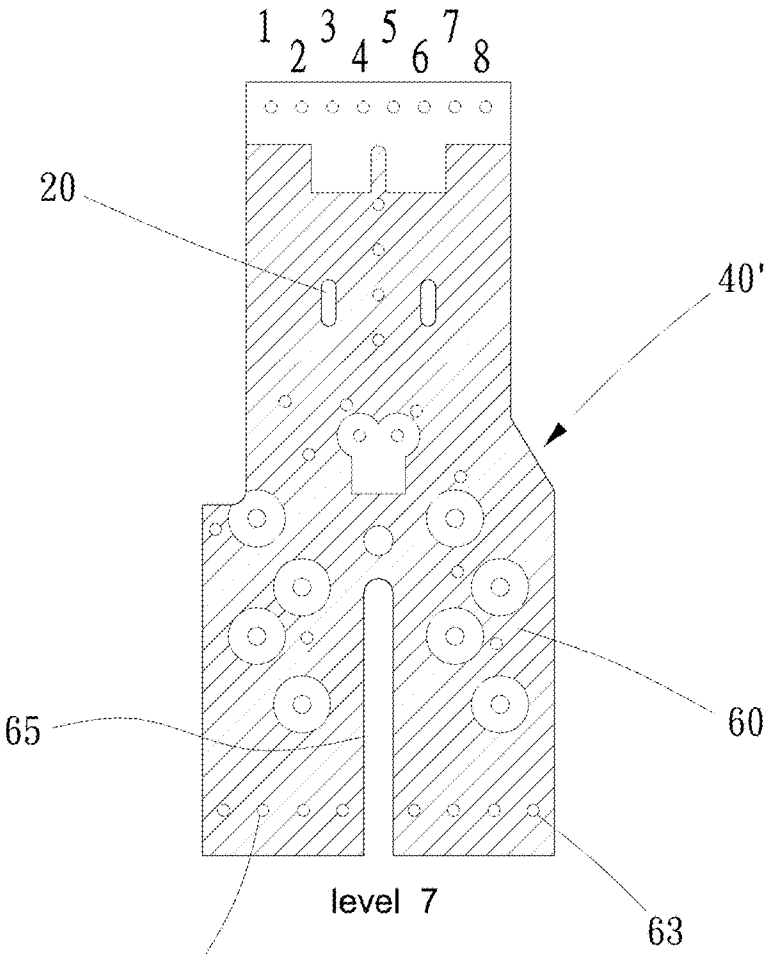
FIG. 25 is another sectional view taken through the PCB between the upper surface and the lower surface of the PCB, showing level 7 with a conductive layer area disposed between the upper surface and the lower surface of the PCB of the plug of FIG. 15.
Figure 26:
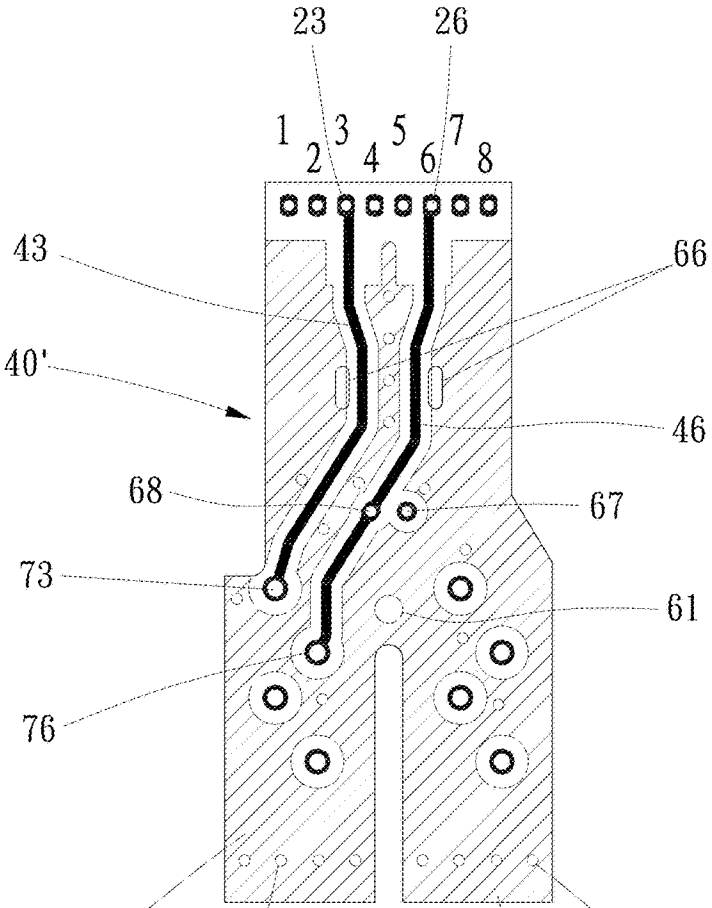
FIG. 26 is a top view showing the upper lower surface that is level 8 with a conductive layer area of the printed circuit board of the plug of FIG. 15.
Figure 27:
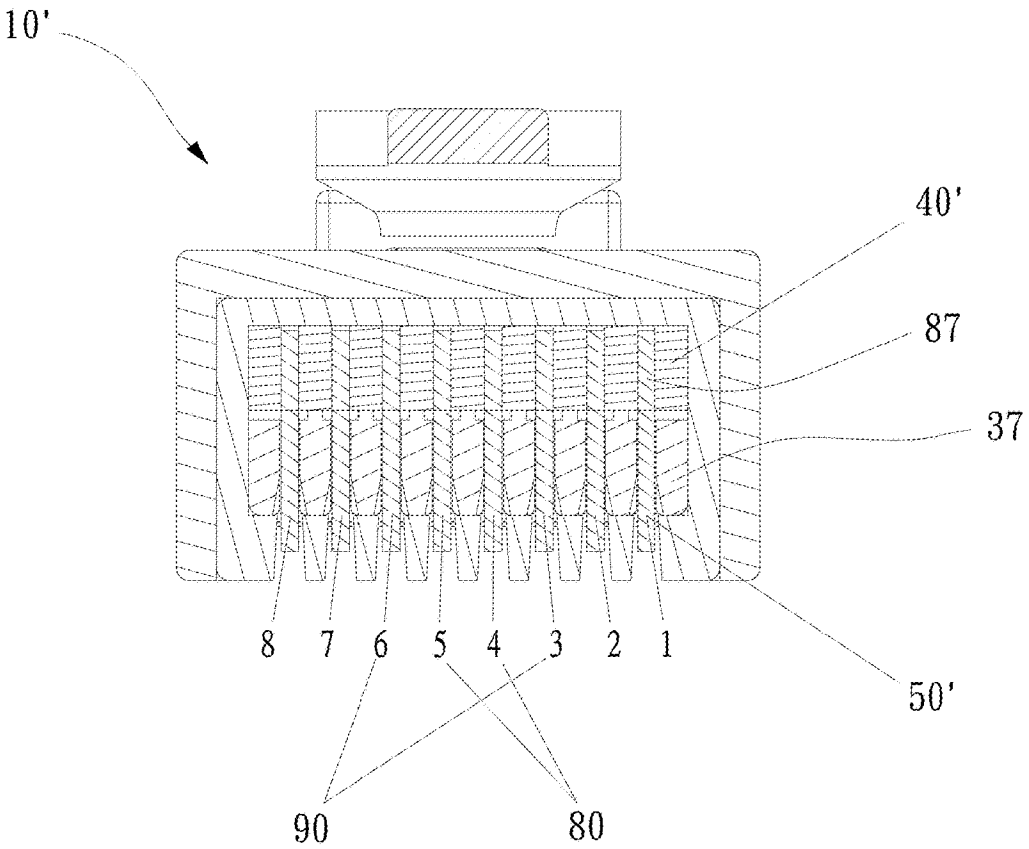
FIG. 27 is a sectional view taken along section line XXVII-XXVII of FIG. 17.
Figure 28:
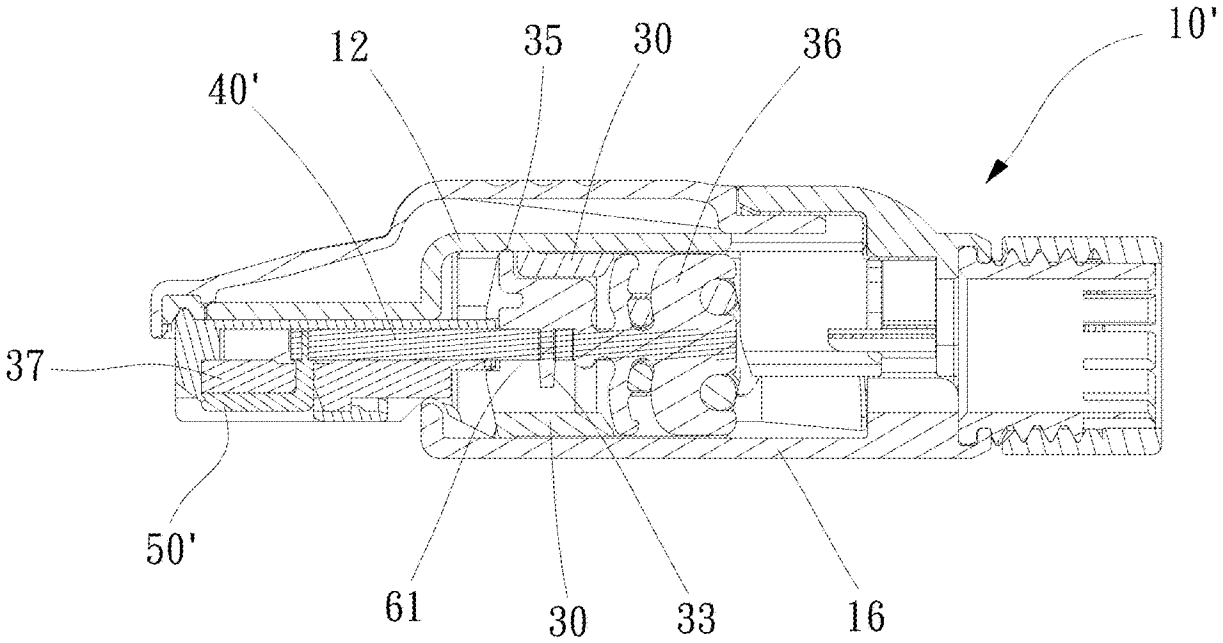
FIG. 28 is a sectional view taken in a plane passing through a conductive metal element and along a longitudinal direction of the plug of FIG. 15.

The plug 10' has blades 50' that have both a press contact of conductor contact portions 59' that electrically and physically contact the blade conductor contact regions 51'-58' on the PCB 40'. The blades 50' also have integrally formed conductive posts 87 in electrical and physical contact with the conductive lining of conductive through openings 21'-28' on the PCB 40'. The conductive through openings 21'-28' each receive a conductor blade post 87 of the conductor blades 50'. As can be seen in FIG. 18, each conductor blade 50' is pressed into or molded into the conductor set base member 37. This positions the plug contact portion 84' (shown horizontally extending) and also holds a staked/pressed portion 85' (shown vertically extending). The horizontally extending plug contact length portion 84' is at an angle (a 90 degree angle) to the vertically extending portion 85'. Each conductor blade 50' includes the conductor contact portion 59' and the blade conductor contact regions 51'-58' on the PCB 40' and each conductor blade 50' includes on conductive post 87 that is received in one of the conductive through openings 21', 22', 23', 24', 25', 26', 27' and 28'. This provides an improved electrical contact.

Figure 29A:
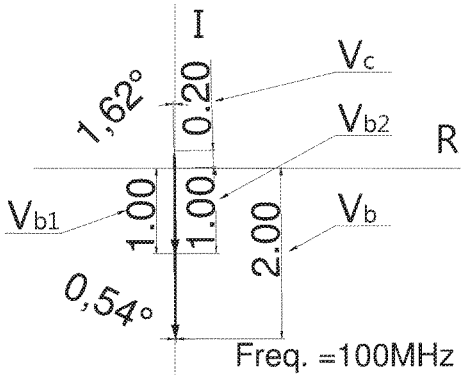
FIG. 29A is a diagram showing vectors contributing to an overall capacitive coupling (capacitive reactance) of the RJ-45 plug at low frequency—100 MHZ.
Figure 29B:
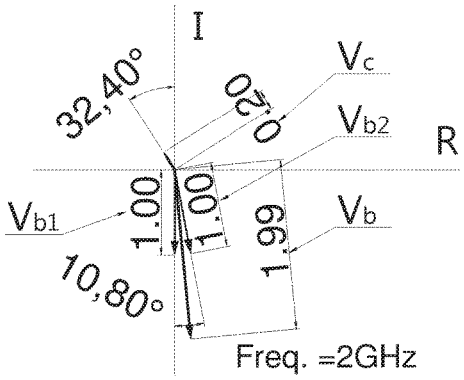
FIG. 29B is a diagram showing vectors contributing to an overall capacitive coupling (capacitive reactance) of the RJ-45 plug at high frequency—2 Ghz.
Figure 29C:
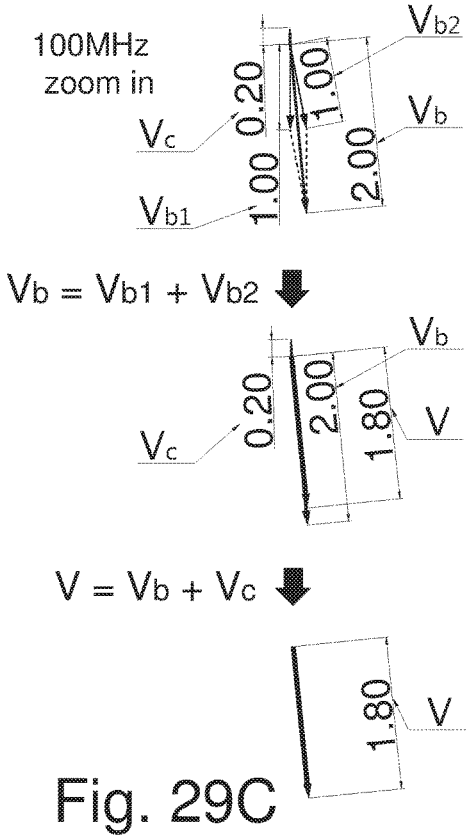
FIG. 29C is an enlarged diagram (100 MHZ zoom in) showing vector summations for the RJ plug of the invention at low frequency—100 MHZ.
Figure 29D:
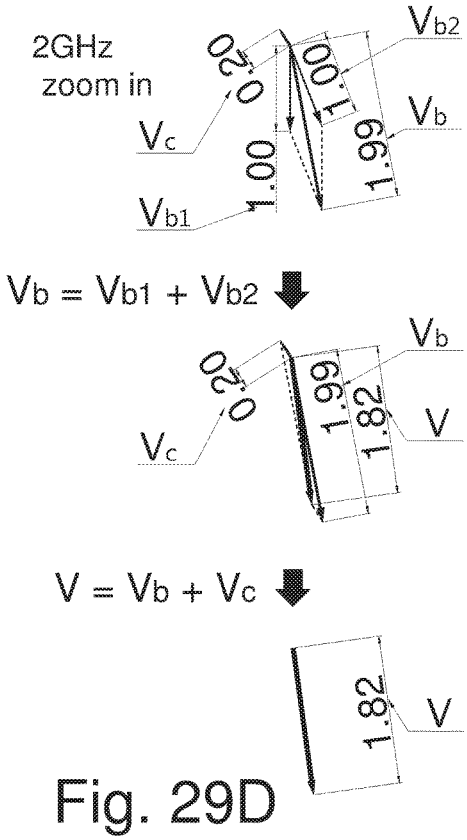
FIG. 29D is an enlarged diagram (2 GHz zoom in) showing vector summations for the RJ plug of the invention at high frequency—2 GHz.

FIG. 29A-D show vector summations for the RJ plugs 10 and 10' of the invention. This shows a reduced difference in overall capacitor couplings at low frequency and high frequency so the difference is more linearly proportional to the frequency. In FIG. 29A-D, the major coupling M1 is comprised of the coupling of the blades 50 and indicated by Vb1 and if needed (to meet the TIA standard requirement of a specific amount of coupling) is further comprised of the coupling arrangement CA/CA' and indicated by Vb2 and M1 is together indicated by coupling Vb. The additional coupling of the small compensation capacitor (minor compensation coupling) C is indicated at Vc. FIG. 29A shows the vector Vb with component vectors Vb1 and Vb2 and the vector Vc with a frequency of 100 MHZ. FIG. 29C, in an enlarged view of the vector summation with a frequency of 100 MHZ, shows in the upper portion the vector summation Vb=Vb1+Vb2, and also shows the opposite polarity vector Vc. In the lower portion of FIG. 29C, the vector summation V=Vb+Vc is shown with a frequency of 100 MHZ. FIG. 29B shows the vector Vb with component vectors Vb1 and Vb2 and the vector Vc with a frequency of 2 GHz. FIG. 29D, in an enlarged view of the vector summation with a frequency of 2 GHz, shows in the upper portion the vector summation Vb=Vb1+Vb2, and also shows the opposite polarity vector Vc. In the lower portion of FIG. 29D, the vector summation V=Vb+Vc is shown with a frequency of 2 GHz. The overall coupling (capacitive reactance) V=Vb+Vc is similar for the frequency of 100 MHz and for the frequency of 2 GHz. The change V=1.80 at 100 MHz and V=1.82 at 2 GHz is more linearly proportional to the frequency change with this configuration including minor compensation coupling C that is indicated at Vc.

While specific embodiments of the invention have been shown and described in detail to illustrate the application of the principles of the invention, it will be understood that the invention may be embodied otherwise without departing from such principles.

LIST OF REFERENCE CHARACTERS

10 RJ plug
12 main housing part
14 latch
16 housing cover
17 receiving portions
18 cable nut
19 stakes
20 PCB additional conductive layering/opening
21 through contact
21' through contact
22 through contact
22' through contact
23 through contact
23' through contact
24 through contact
25 through contact
26 through contact
26' through contact
27 through contact
27' through contact
28 through contact
28' through contact
29 stake portions
30 wire management assembly
31 receiving portions
32 set screw
33 conductive pins of metal piece
34 grounding spring
35 metal piece grounding spring
36 metal piece
37 conductor set base member
38 conductor set cover member
39 coupling portion
40 PCB
41 circuit trace
42 circuit trace
43 first split pair trace
44 first central pair trace
45 second central pair trace
46 second split pair trace
47 circuit trace
48 circuit trace
49 coupling portion
50 blade conductors
51 blade conductor contact region
52 blade conductor contact region
53 first split pair blade conductor contact region
54 first central pair blade conductor contact region
55 second central pair blade conductor contact region
56 second split pair blade conductor contact region
57 blade conductor contact region
58 blade conductor contact region
59 conductor contact portion
60 conductive layer material area
61 conductive through holes
62 upper surface conductive layer/contact conductive material area
63 electrical through contacts
64 lower surface conductive layer/contact conductive material area
65 gap in PCB
66 opening inner facet conductive layer material
67 through contact
68 through contact
69 compensation coupling portions
70 compensation coupling portions
71 wire terminal contact
72 wire terminal contact
73 wire terminal contact
74 wire terminal contact
75 wire terminal contact
76 wire terminal contact
77 wire terminal contact
78 wire terminal contact
79 trace
80 central pair transmission line
84 plug contact portion
84' plug contact portion
85 staked/pressed extending portion
85' staked/pressed extending portion
87 conductive post
88 passages
90 split pair transmission line
M1 major coupling
CA/CA' coupling arrangement
C minor compensation coupling

What is claimed is:

1. An RJ-45 plug for high frequency applications, the plug comprising:
- a housing;
- a plurality of contact conductor blades;
- insulation displacement contacts;
- a printed circuit board (PCB) with a plurality of transmission paths connecting corresponding blades and insulation displacement contacts, wherein:
- the plug has a major capacitive coupling comprising capacitive coupling between immediately adjacent contact conductor blades and corresponding connected circuit parts of the PCB;
- the PCB further comprise a compensation coupling arrangement that provides a smaller coupling as compared to the major coupling;
- the compensation coupling is no more than one half of the major coupling and has a different polarity from that of the major coupling;
- the compensation coupling is connected to a set of transmission paths at a location between the major coupling and the insulation displacement contacts.

2. A plug according to claim 1, wherein a magnitude of the compensation coupling arrangement is less than 1/10th of a magnitude of the major coupling.

3. A plug according to claim 2, wherein the compensation coupling arrangement is electrically connected to the contact conductor blade at a path distance from the contact conductor blades that is more than 5 mm.

4. An RJ-45 plug for high frequency applications according to claim 1, wherein corresponding connected circuit parts of the PCB further comprises a coupling arrangement adjacent to the plurality of contact conductor blades and the coupling arrangement forms a major capacitive coupling.

5. A plug according to claim 4, wherein:

the PCB has a plurality of blade conductor contact regions connecting respective contact conductor blades to the respective transmission paths associated therewith;

the contact conductor blades comprise a central pair of conductor blades disposed adjacent to each other and in electrical contact with a central pair of blade conductor contact regions of the plurality of blade conductor contact regions;

the contact conductor blades comprise a split pair of conductor blades, with each split pair of conductor blades disposed adjacent to a respective one of the central pair of conductor blades and in electrical contact with a split pair of blade conductor contact regions of the plurality of blade conductor contact regions;

the coupling arrangement comprises a first split pair to central pair coupling portion provided on the PCB and electrically connected to one of the central pair of blade conductor contact regions and electrically connected to the adjacent split pair of blade conductor contact regions providing a capacitive coupling therebetween;

the coupling arrangement further comprises a second split pair to central pair coupling portion provided on the PCB and electrically connected to another of the central pair of blade conductor contact regions and electrically connected to the adjacent split pair of blade conductor contact regions providing a capacitive coupling therebetween;

the first split pair to central pair coupling portion is connected to said one of the central pair of blade conductor contact regions and the adjacent split pair of blade conductor contact regions spaced a distance D therefrom;

the second split pair to central pair coupling portion is connected to said another of the central pair of blade conductor contact regions and the adjacent split pair of blade conductor contact regions spaced a distance D therefrom;

the compensation coupling arrangement comprises a split pair to central pair compensation coupling portion electrically connected to one of the traces connected to one of the central pair of blade conductor contact regions and electrically connected to one of the traces connected to one of the adjacent split pair of blade conductor contact regions that is adjacent to said one of the traces connected to one of the central pair of blade conductor contact regions providing a capacitive coupling therebetween;

the compensation coupling arrangement is spaced a distance d, along the associated trace from the compensation coupling arrangement to the conductor contact regions; and d>>D.

6. A plug according to claim 1, wherein:

the PCB has a plurality of blade conductor contact regions connecting respective contact conductor blades to the respective transmission paths associated therewith;

each blade conductor comprises a plug contact length portion having a blade contact length for contact with contact conductors of a receiving jack and an extending portion extending at an angle relative to the plug contact length portion; and the extending portion terminates at conductor contact portion that has a contact surface that electrically and physically contacts the respective blade conductor contact region.

7. A plug according to claim 6, wherein the housing comprises one or more housing parts supporting the plurality of contact conductor blades and supporting the PCB and clamping the contact conductor blades and the PCB to press, with a pressing force, the conductor contact portion of each of the plurality of contact conductor blades into contact with the associated one of the conductor contact regions of the PCB to provide a solderless electrical and physical connection between each of the contact conductor blades and a corresponding one of the transmission path blade conductor contact regions.

8. A plug according to claim 6, wherein;

the housing comprises one or more housing parts supporting the plurality of contact conductor blades and supporting the PCB;

each of the contact conductor blades comprises a conductive post integral with the extending portion; and each of the conductor contact regions comprise plated though openings of the PCB that receive one of the conductive posts to provide electrical contact between the conductor contact regions region and the associated contact conductor blade.

9. A plug according to claim 8, wherein the conductive posts received in the plated though openings stake the respective contact conductor blade to the PCB.

10. A plug according to claim 1, wherein the housing comprises one or more housing parts supporting plurality of contact conductor blades and supporting the PCB.

* * * * *